US006637610B1

(12) United States Patent
Cheeseboro

(10) Patent No.: US 6,637,610 B1
(45) Date of Patent: Oct. 28, 2003

(54) PERSONAL TRANSPORTER

(76) Inventor: Robert G. Cheeseboro, 5544 Saloma Ave., Van Nuys, CA (US) 91411

( * ) Notice: Subject to any disclaimer, the term of this patent is extended or adjusted under 35 U.S.C. 154(b) by 0 days.

(21) Appl. No.: 09/831,319

(22) PCT Filed: Nov. 6, 1999

(86) PCT No.: PCT/US99/26180

§ 371 (c)(1),
(2), (4) Date: May 7, 2001

(87) PCT Pub. No.: WO00/27333

PCT Pub. Date: May 18, 2000

Related U.S. Application Data

(60) Provisional application No. 60/107,451, filed on Nov. 6, 1998.

(51) Int. Cl.[7] ..... B66C 17/06; B66C 19/00; A61G 7/10

(52) U.S. Cl. ..... 212/327; 212/324; 5/83.1; 5/89.1

(58) Field of Search ..... 212/327, 324, 212/345, 312; 104/126; 5/81.1 R, 83.1, 85.1, 87.1, 86.1, 89.1

(56) References Cited

U.S. PATENT DOCUMENTS

| | | | | | |
|---|---|---|---|---|---|
| 787,760 | A | * | 4/1905 | Higgins | 212/345 |
| 3,490,385 | A | * | 1/1970 | Gibbins et al. | 104/126 |
| 3,877,089 | A | * | 4/1975 | Spivey et al. | 5/85.1 |
| 4,041,875 | A | * | 8/1977 | Wallace | 104/126 |
| 4,296,509 | A | * | 10/1981 | Simmons et al. | 248/168 |
| 4,360,307 | A | * | 11/1982 | Larsson | 212/180 |
| 4,446,587 | A | * | 5/1984 | Jump | 254/292 |
| 4,627,119 | A | * | 12/1986 | Hachey et al. | 5/85.1 |
| 4,805,248 | A | * | 2/1989 | Lunau | 5/83.1 |
| 5,072,840 | A | * | 12/1991 | Asakawa et al. | 212/312 |
| 5,337,908 | A | * | 8/1994 | Beck, Jr. | 104/126 |
| 5,388,289 | A | * | 2/1995 | Casperson | 280/250.1 |
| 5,406,658 | A | * | 4/1995 | Olkkonen et al. | 5/83.1 |
| 5,499,408 | A | * | 3/1996 | Nix | 5/83.1 |
| 5,511,256 | A | * | 4/1996 | Capaldi | 403/217 |
| 5,570,482 | A | * | 11/1996 | Asakawa | 5/81.1 C |
| 5,615,426 | A | * | 4/1997 | Hokett | 5/486 |
| 5,694,654 | A | * | 12/1997 | Roy | 5/83.1 |
| 5,708,993 | A | * | 1/1998 | Campbell et al. | 177/144 |
| 6,006,376 | A | * | 12/1999 | Williamson | 5/83.1 |

* cited by examiner

*Primary Examiner*—Dean J. Kramer
*Assistant Examiner*—Paul T. Chin

(57) ABSTRACT

Structure and procedures for lifting, transferring and moving a person, such as a bed ridden person or one requiring the use of a wheelchair, involve a frame (393) supported on wheels (394, 395), a horizontal load supporting beam (392) in an upper part of the frame, and a motor-powered winch (391) supported by the frame (393) for movement along the beam. Med winch (391) can be arranged to synchronously raise and lower a pair of horizontally spaced couplings by which a carrier (480) for a person can be connected to the winch (391). The beam (392) can be of variable length. The frame (393) can include a pair of beam-supporting legs (406, 407), one of which can be movable along and removable from the beam as extended from a minimum length state in which the frame (393) can be moved through a doorway. The frame (393) can be of fixed width, with the beam extendible from a side of the frame in conjunction with ground-engaging stabilizers (446, 446') which are extendible from the frame to support the frame from overturning when a person is supported outside the frame from the extended beam (413). A carrier (480) for a person can be a fabric construction which has stiffened back (483) and seat portions, and a lift point at each side of the carrier (480). Another form of carrier can also serve as a portion of a bed.

53 Claims, 28 Drawing Sheets

FIG.27
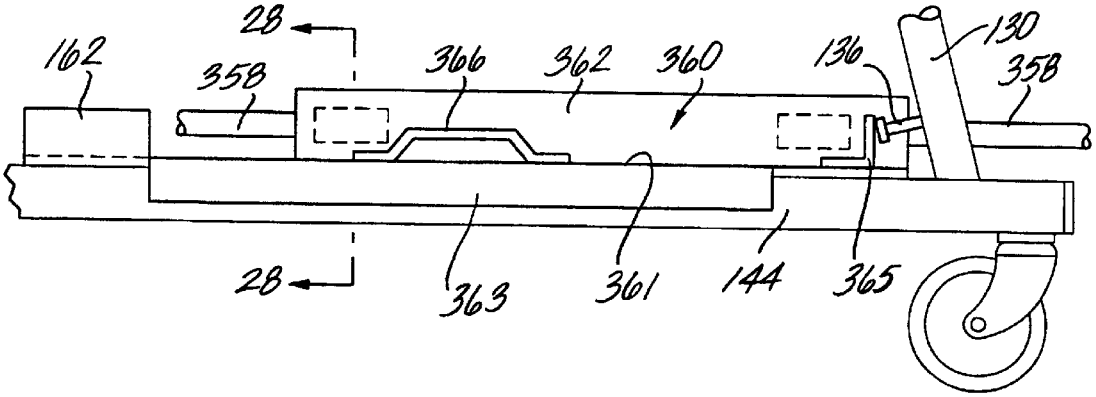
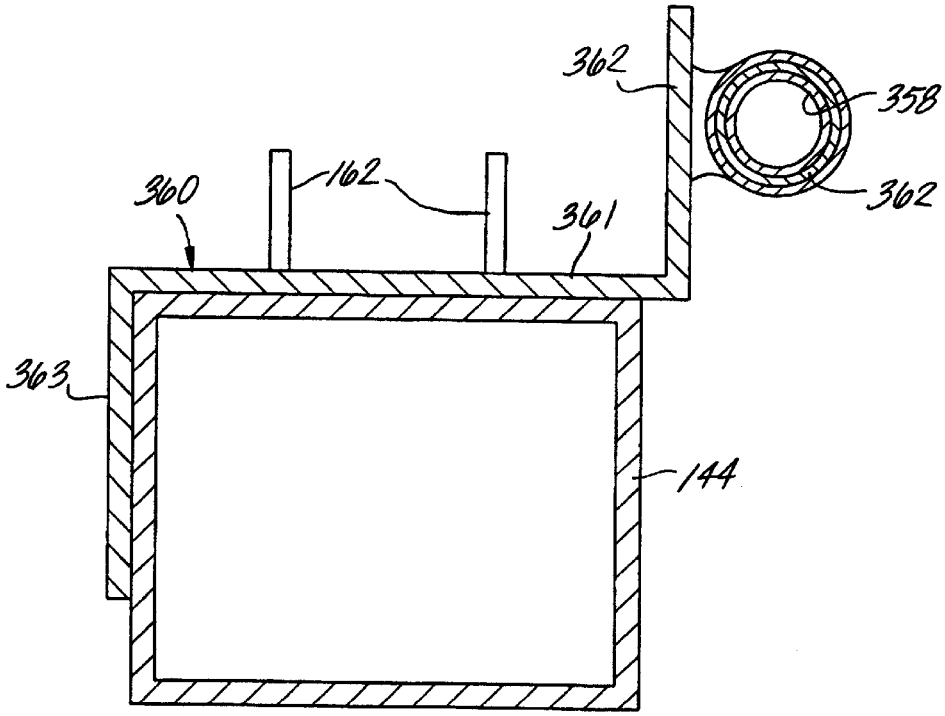
FIG.28

PERSONAL TRANSPORTER

INCORPORATION BY REFERENCE

This application claims the priority of U.S. Provisional Application No. 60/107,451, filed Nov. 6, 1998, the portions of which are listed infra are incorporated herein by reference: description, drawings, and Appendices A and B

FIELD OF THE INVENTION

This invention pertains to structures, systems, and procedures for the lifting, transfer, and transport of individuals requiring assistance.

BACKGROUND OF THE INVENTION

Persons with disabilities represent 20% of the population of the United States alone or, presently, 54 million people. This is a growing percentage due to the world-wide advances in life-saving techniques and medical technology. Consequently, seriously injured or disabled persons now live productive lives yet need to have assistive equipment to enhance their quality of life.

This invention arises from the recognition of a need of an individual to lift and to transfer her 96 year old invalid grandmother. The attending granddaughter, a young woman who was herself pregnant, could not easily and safely accomplish her tasks of lifting, changing, bathing, transferring, and transporting the patient using an existing movable floor-supported cantilever-type patient lift device. That lift device tended to dig its front wheels into the bedroom carpeting when being moved and got in the way of the attendant as she lifted the patient. It also threatened to injure the attendant as she moved the patient because the patient was suspended in a sling from the end of the device's cantilevered lifting beam. The patient felt extremely insecure during those times when the patient was supported only in the lift device.

SUMMARY OF THE INVENTION

This invention addresses needs of the kind described above, and the deficiencies and limitations of existing products. Broadly, this invention provides a personal transporter which can be used to lift a person, to transfer a person from one place of support to a different adjacent place of support, and to move a person from place to place. One of the structural aspects of the invention is a personal movement system ("PMS") and a patient positioning system ("PPS") which together constitute a presently preferred form of the invention for use with persons. Portions of the PMS aspect of this invention can be used in an expandable utility lifter ("EVL") which has advantage and utility in lifting and transporting things other than people in home, commercial and industrial contexts.

The PMS provides a wide range of flexibility and safety in the lifting, transferring and transporting of a physically disabled person to and from a bed, wheel-chair, toilet or bath, vehicle, swimming pool, spa, room, floor, etc. A major component of the PMS aspect of the invention is a lifter/transfer/transporter (LTT) unit. The LTT is a laterally expansible structural frame having planar A-frame type legs which can be positioned over a bed to lift a person and to transfer that person to a wheel chair, for example. The LTT can be compacted or reduced in width from an extended state, say a 7½ foot (229 cm.) span, to a minimized state, say a 2½ foot (76 cm.) width, for transporting the person from place to place. The weight of a person supported by the LTT is centered, in most instances, within a rectangular pattern of four wheels. The PPS preferably is used in connection with the PMS to provide capabilities heretofore available only through the use of a combination of separate products currently available to the disabled or bedridden.

The PPS is an articulated patient support device which does not rely upon the use of web-type slings commonly used with patient lifters now available in the marketplace. The PPS can have a range of supportive configurations. It can be horizontal and serve as a stretcher. It can be arranged into various seat shapes or configurations. It can be slanted to assist in standing. The PPS structure, when combined with a special mattress arrangement, can become part of the patient's bed and allows the patient to be readily turned, lifted, seated, transferred and transported by the PMS.

The structures, systems and procedures of this invention provide the following features, benefits and advantages: multifunction capacity in lift, transfer, and transport of the disabled; collapsible vehicle supporting a person from a wide over-bed state (say 7½ feet) to a narrow width (say 2½ feet) for movement through a doorway; safe lift and transfer of a person from bed to wheelchair; the caregiver is not required to support any significant portion of the patient's weight; easy transport of a patient from a location of patient pick-up to an adjacent location; the patient has enhanced positional security and stability during transport; patient weight is centered within four wheels of a supporting structure which facilitates transfer and transport functions; self-contained battery-powered lift and transfer operations; dual strap, dual-ball screw lifting hoist with separate motors for lift and transfer functions; wall and vehicle brackets provide enhanced flexibility and utilities; seat structures allow articulated and controlled movement of the patient when lifting and transferring the patient. Additional features and advantages of the invention are developed in the following descriptions of the PMS, the PPS, and of a form of the invention useful for easily and safely moving a person into and out of a passenger seat in an aircraft.

This invention provides an apparatus for transporting a person and includes a frame movable on supporting wheels connected to the frame. The frame includes a horizontal beam in an upper portion of the frame. A reversible motor-driven winch mechanism is supported by the beam. The winch mechanism is operable to take in and pay out at least one flexible load carrying element which ends at a coupling by which the element can be releasably connected in load supporting relation to a carrier for supporting a person. The apparatus includes positioning means cooperable between the frame and the carrier supporting a person for holding the carrier and the person in a desired relation to the frame.

Another aspect of the invention provides an apparatus for transporting a person in which the apparatus includes a variable-length beam and a pair of leg assemblies supporting the beam horizontally at a selected elevation. A motor-driven winch mechanism is supported by the beam and is movable along the beam between the leg assemblies. One of the leg assemblies is selectively movable toward and away from the other leg assembly during load-supporting engagement of the one leg assembly with the beam.

A further aspect of the invention provides an apparatus for moving a person in which there is a frame which is movable on supporting wheels. A reversible motor-driven winch mechanism is supported in an upper location in the frame. The winch mechanism is operable to take in and pay out in synchronism at spaced locations in the winch a pair of flexible load carrying elements. Couplings are carried by the load carrying elements by which the elements can be releasably connected in load supporting relation to a carrier for supporting a person.

A still further aspect of this invention is a carrier for supporting a person in a hoist. The carrier comprises a fabric construction having back and seat portions which are disposable behind the back and under the buttocks and thighs of a person. A reinforced zone of the construction extends under the seat portion and upwardly from opposite sides of the seat portion to a height above the seat portion to about the waist of a person supported by the seat portion. The construction includes a pair of side flaps which are extendible from respective side edges of the back portion around the sides and across the front of a person supported by the seat portion to end margins. The flaps can be connected to each other at their end margins to at least partially enclose the torso of the person. A support strap is associated with each side flap. Each support strap is connectible with the corresponding end of the reinforced zone and can pass through a guide on the side of the corresponding flap to an upper end of the strap. The upper end of each strap carries a device by which the strap can be connected to the hoist and by which a person in the carrier can be raised and lowered by operation of the hoist.

DESCRIPTION OF THE ACCOMPANYING ILLUSTRATIONS

The above-mentioned and other aspects of structures and procedures according to this invention are more fully set forth in the following description of presently preferred and other embodiments of the invention, which descriptions are presented with reference to the accompanying drawings, in which:

FIG. 27 is a fragmentary elevation view of a guide arrangement useful to guideably couple a transporter of the kind shown in FIG. 1, e.g., to a bed spanned by an expanded transporter;

FIG. 28 is an enlarged cross-sectional view taken along line 28—28 in FIG. 27;

DESCRIPTIONS AND DISCUSSIONS OF EMBODIMENTS OF THE INVENTION

Figures 1, 2:
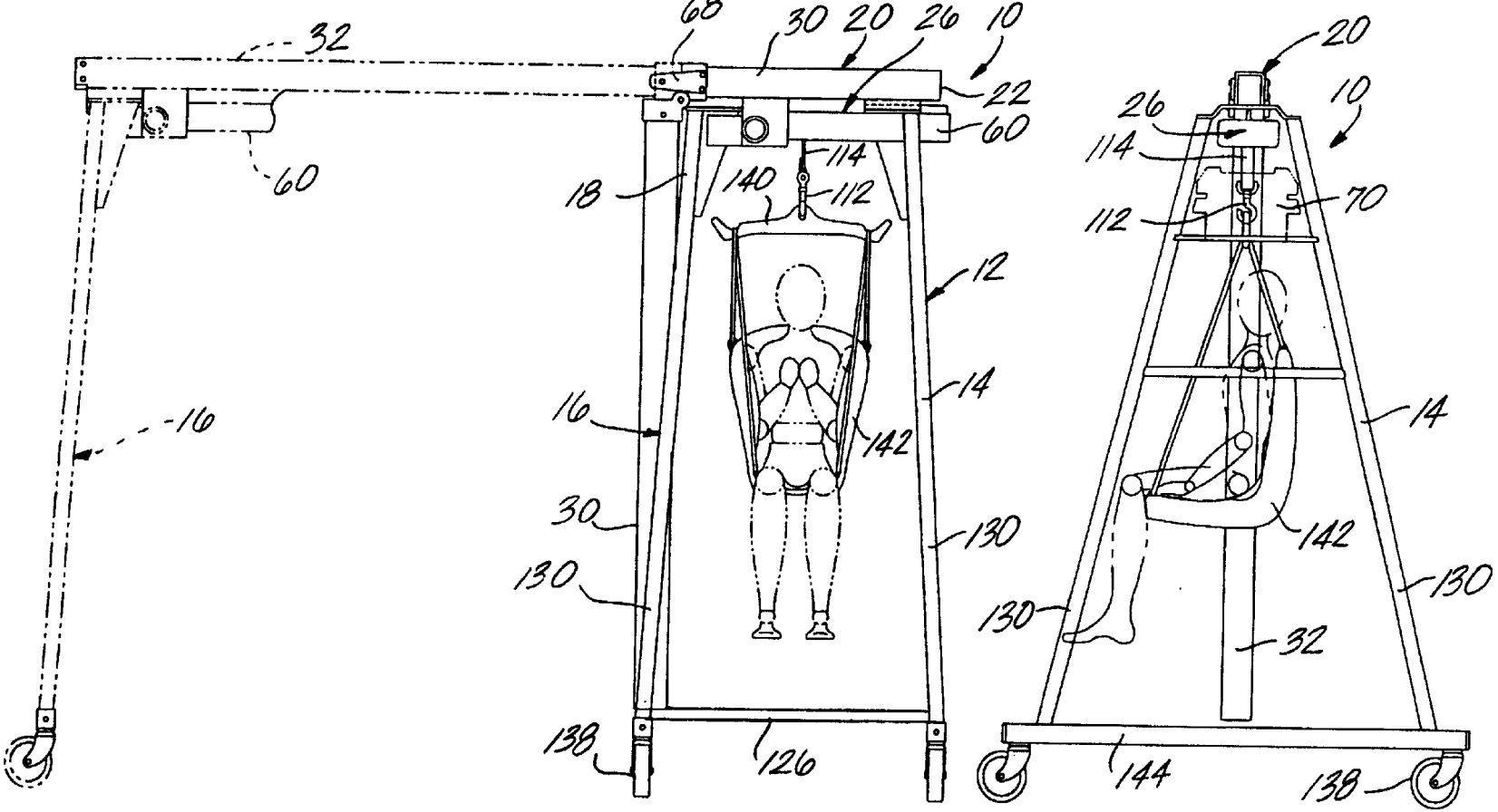
FIG. 1 is a general front elevation view of a personal transporter of this invention and depicts the transporter in its minimum width (solid lines) and expanded width (phantom lines) states.
FIG. 2 is a general and elevation view of the transporter of FIG. 1.
Figure 3:
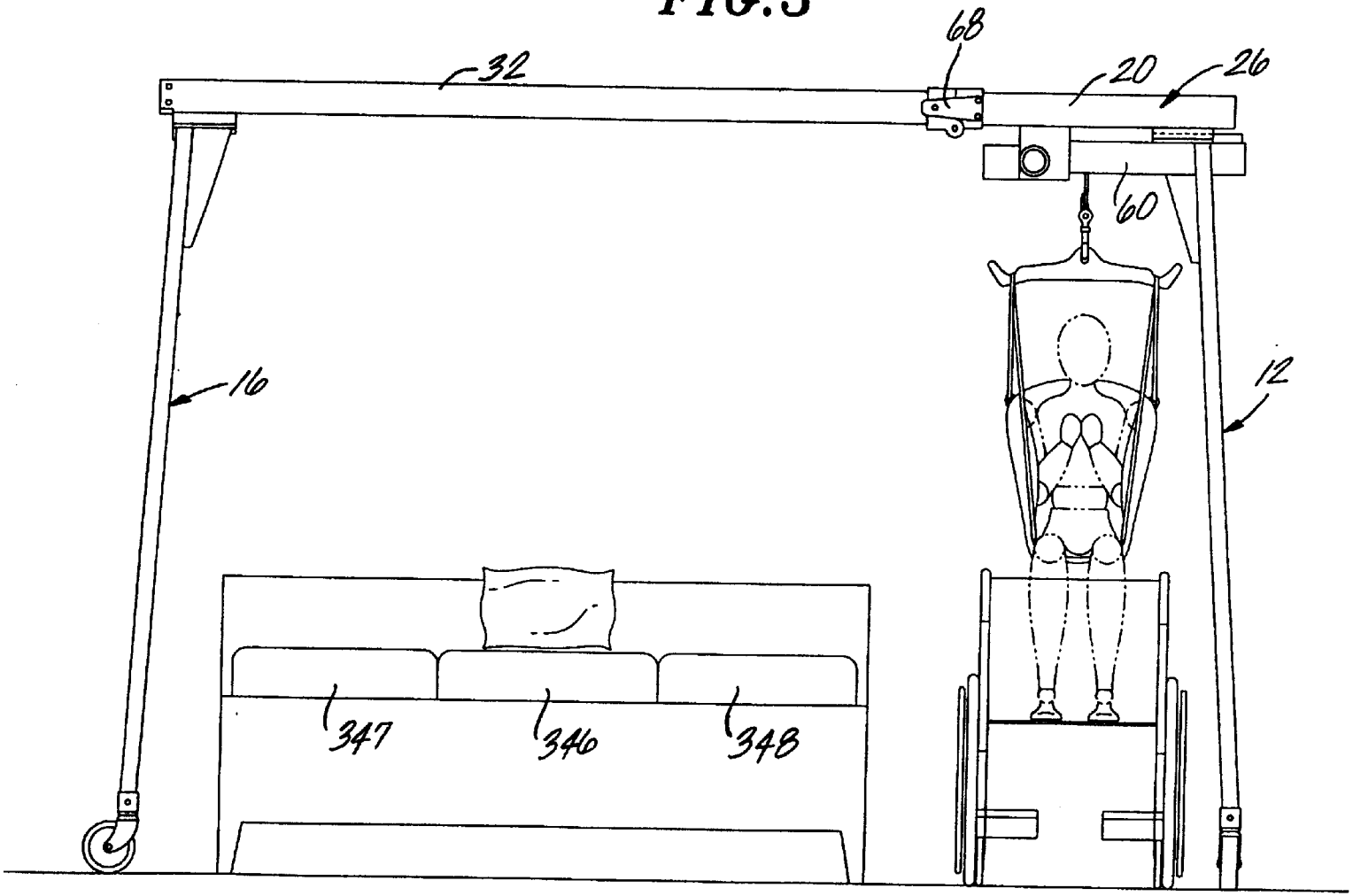
FIG. 3 is a front elevation view of the transporter in an expanded state encompassing a bed and a chair space adjacent the bed.

A personal movement system (hereinafter referred to as "PMS" or "transporter") 10 according to an embodiment of the present invention is shown in FIGS. 1 through 3. The personal transporter 10 includes a right leg assembly 12 having a fixed leg 14 and a left leg assembly 16 having a movable and removable left leg 18. Right leg assembly 12 is fixedly connected to the right end 22 of a beam channel 20 of a hoist and channel assembly 26 while the left leg assembly 16 is moveably and removably connected to the hoist and channel assembly 26. FIG. 1 shows in solid lines the transporter in its compact, minimum-width configuration in which the overall distance between the outside surfaces of the leg assemblies 12, 16 at their lower ends has a design value of 30 inches (76.2 cm.). See also FIG. 5, e.g.

Figure 5:
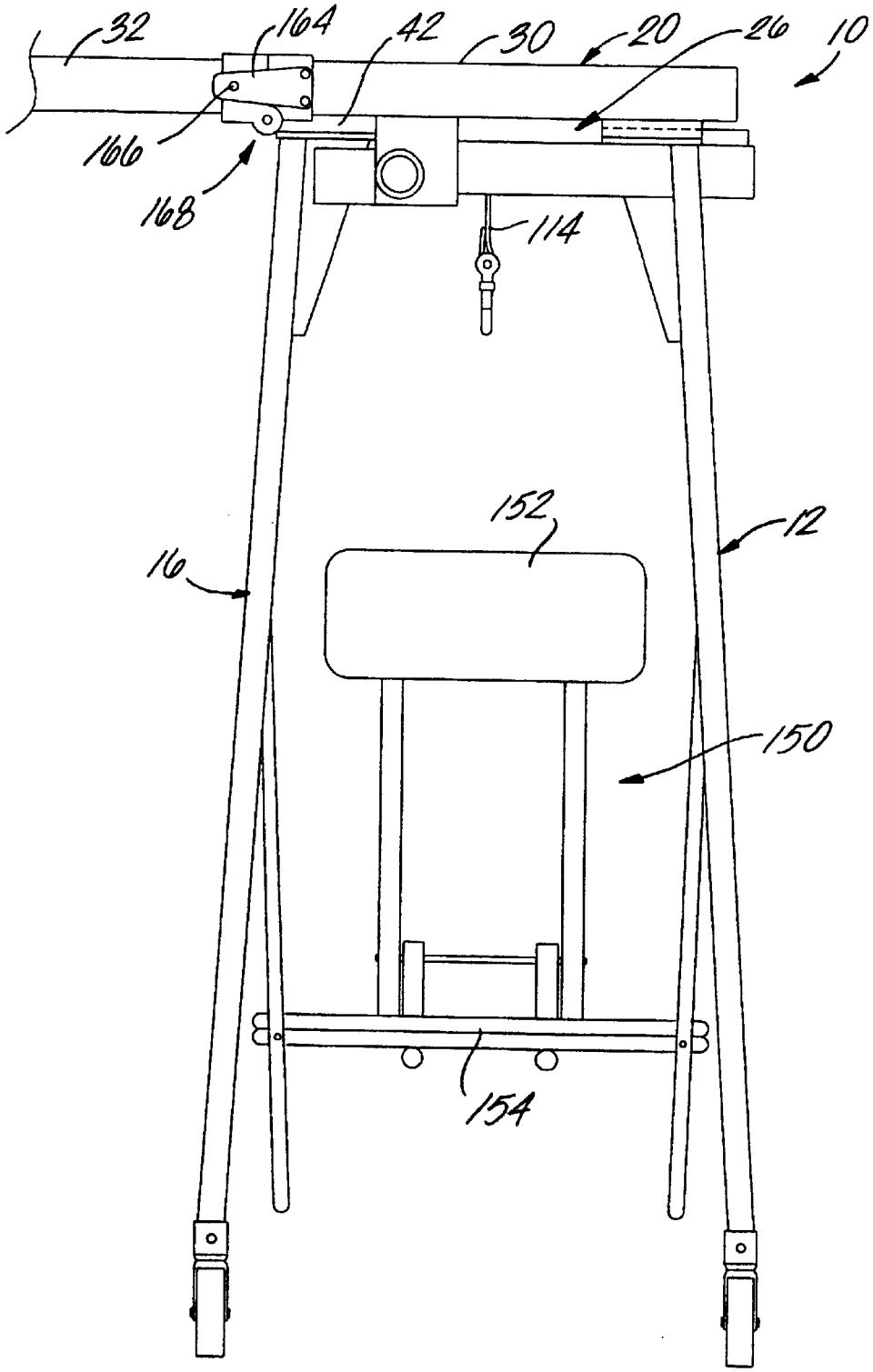
FIG. 5 is a front elevation view showing a demountable and collapsible seat assembly in place in the transporter for supporting a person in a stable position in the transporter.

The beam structure of the hoist and channel assembly 26 is composed of a short base channel length 30 to which the upper end of right leg assembly 12 is fixably connected, and a longer movable channel length 32 which is hingeably connected to the left end of base channel length 30 as shown in FIGS. 1 and 5. FIG. 1 depicts in solid lines the longer movable channel length 32 of the beam in its vertical stowed position corresponding to the minimum-width state of the transporter. FIG. 1 also shows in broken lines the deployed or in-use position of the longer channel length 32 in which the longer and base channel lengths 30, 32 are collinear and horizontal. Correspondingly, at the extreme left side of FIG. 1, left leg assembly 16 is depicted in broken lines in the position it occupies when it has been moved along the extended beam from the right leg assembly; in its extended or expanded state, the width of the transporter has a design value of 91.75 inches (233.0 cm.).

Figure 9:
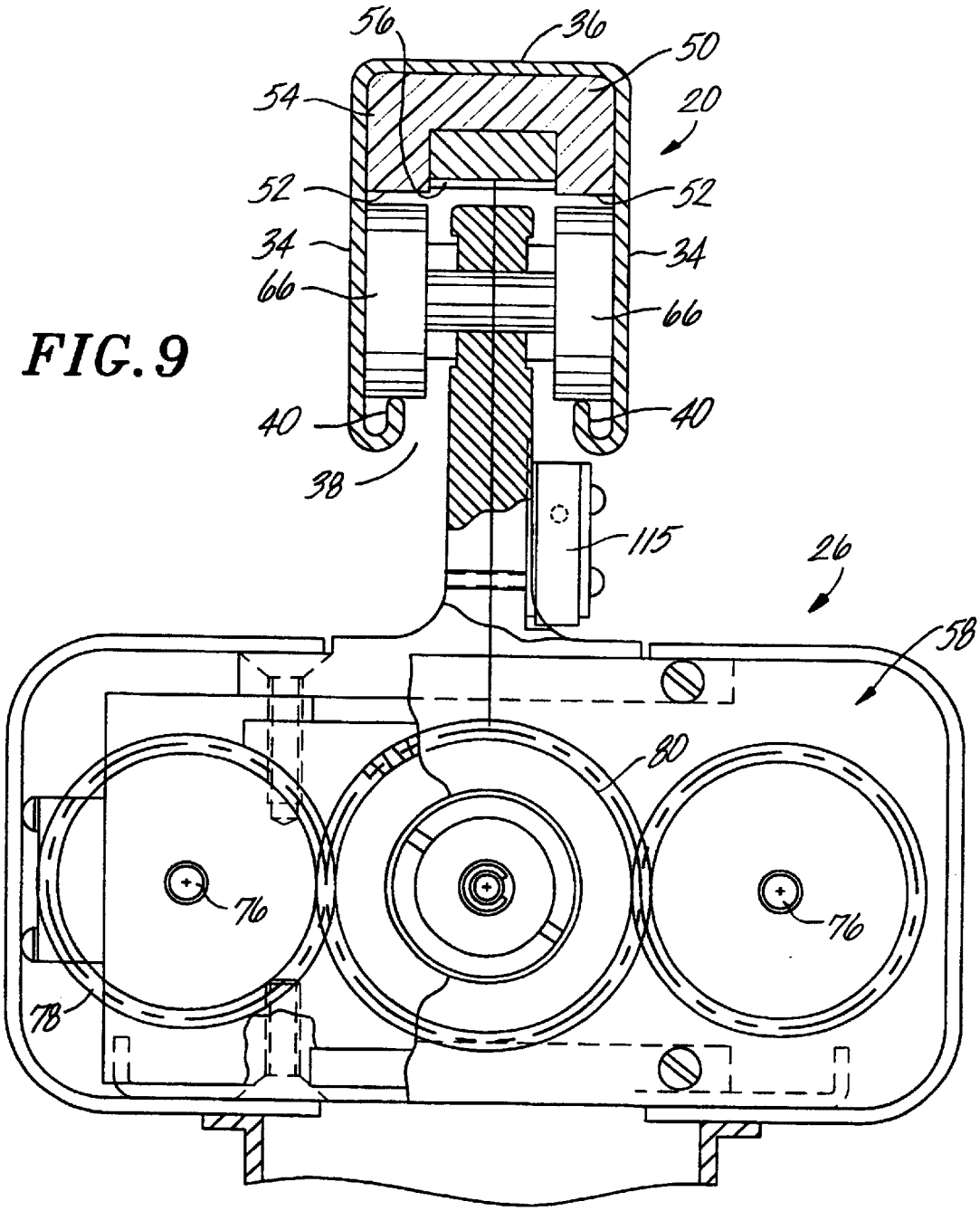
FIG. 9 is an enlarged fragmentary elevation view, partially in cross-section, showing the mounting of a winch mechanism by the horizontal support beam in a transporter according to this invention.

FIG. 9 shows that the channel which serves as the connecting beam 20 between the upper ends of the left and right leg assemblies 12, 16 has closed side and top surfaces 34, 36 but is downwardly open at its bottom 38 between adjacent inwardly and upwardly turned lips or flanges 40. The beam channel preferably is a formed steel element. The short and long lengths of the channel 30, 32 have the same cross-sectional configurational and dimensional properties.

Figure 16:
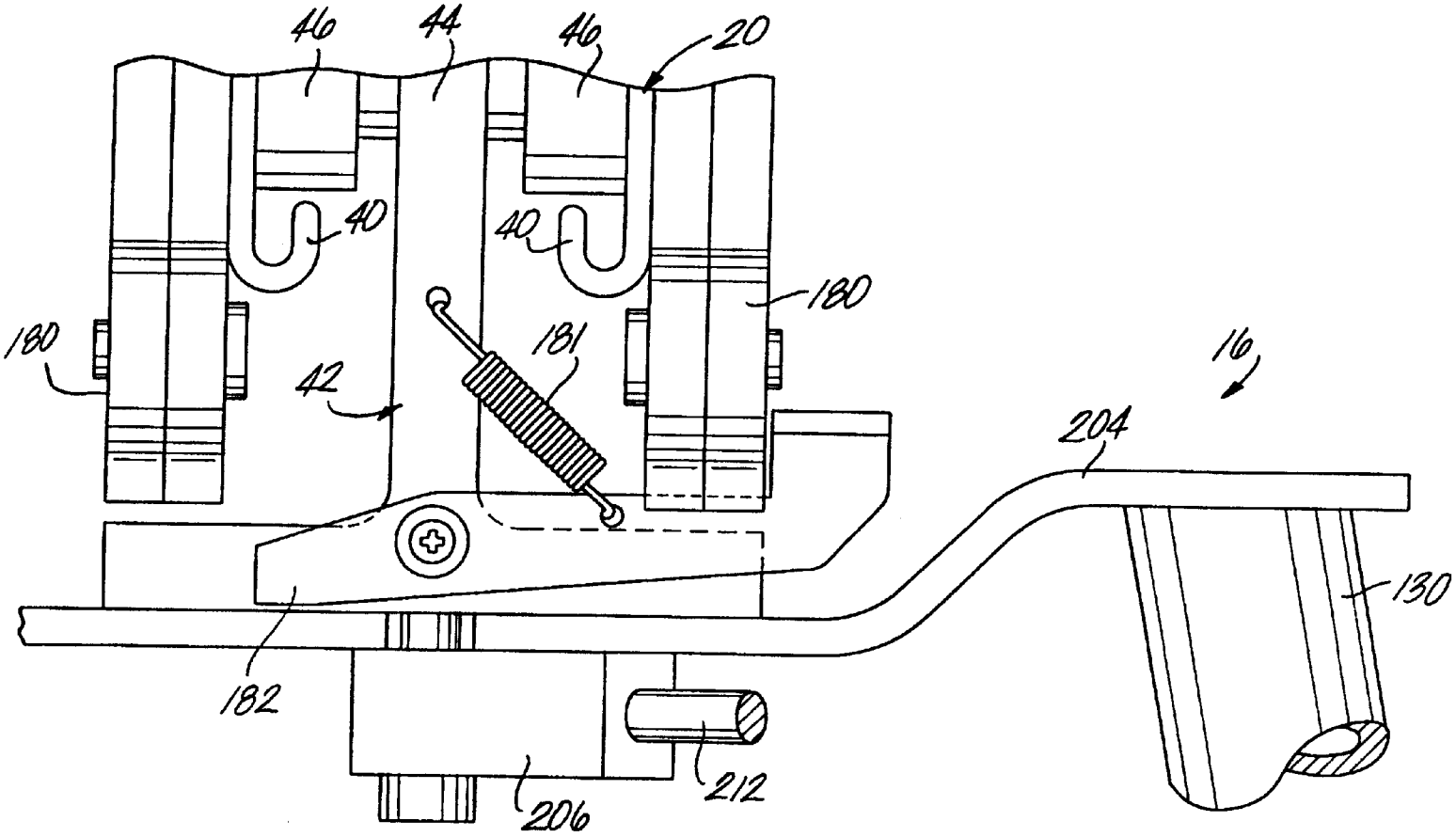
FIG. 16 is an enlarged fragmentary elevation view of the latch mechanism engageable between the carriage for a movable leg of the transporter and the hinge connection in an extendible horizontal beam of the transporter.

As shown in FIG. 16, e.g., the movable leg assembly 16 is connected at its upper end to the channel 20 via rollers or wheels 46 carried on opposite sides of an upstanding rib 44 of a carrier 42 which is releasably affixed to the top of the moveable leg assembly 16. Wheels 46 preferably are the outer races of ball-bearing assemblies and normally ride against bottom surfaces 52 of an insulator 50 which occupies the upper inner portion of the channel 20; see FIG. 9. The cross-sectional shape of the insulator 50 is that of an inverted"U." The wheels 46 for the movable leg assembly 16 bear upon the ends of the legs 54 of the inverted "U." An electrically isolated, downwardly facing, metal rack 56, i.e., linear gear, is carried between the insulator legs 54 in the upper portions of both the long and short channel lengths 30, 32.

In a presently preferred embodiment, two sets of two wheels 46 are used to mount the upper end of movable leg assembly 16 to the channel 20. Each set of wheels has two coaxially aligned wheels 46. The sets are spaced at opposite ends of the carrier 42 which extends along the length of the channel 20 for a short distance. The presently preferred cross-sectional form of the carrier is that of an inverted "T" in which rib 44 is the stem of the T.

Figure 10:
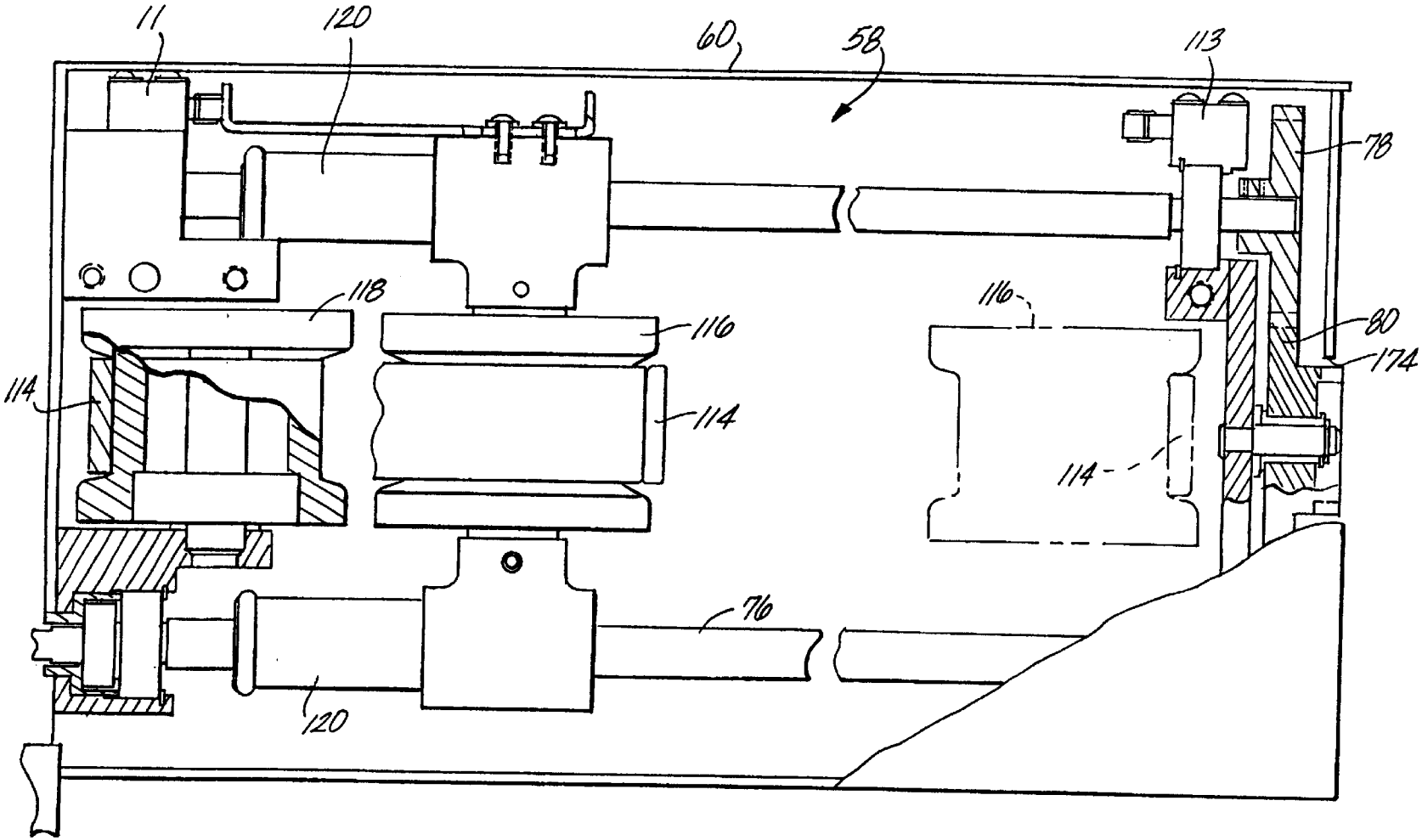
FIG. 10 is a fragmentary plan view, partially in cross-section, of the hoist drive aspects of a winch mechanism according to this invention.
Figure 11:
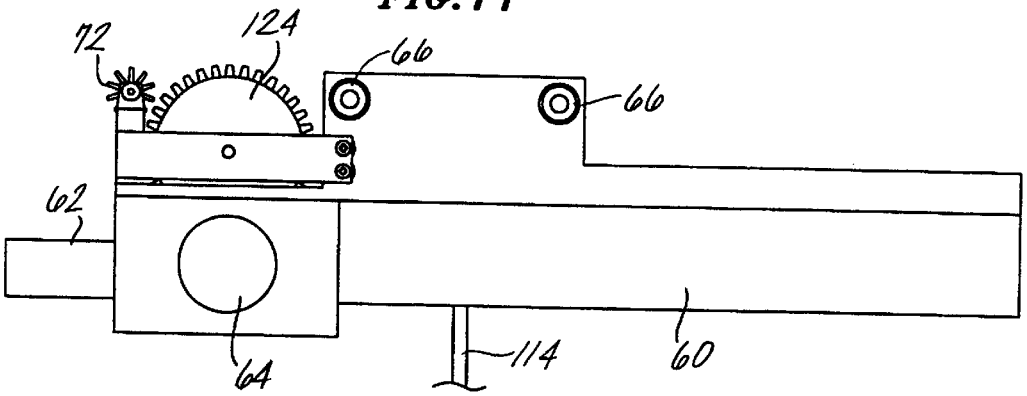
FIG. 11 is a generalized elevation view of a winch housing and its support, apart from the horizontal beam, useful in a transporter according to this invention.

A further component of hoist and channel assembly 26 is a winch mechanism 58 and its housing 60 (FIGS. 9 and 10) which also carries separate reversible winch and traverse (horizontal) drive motors 62, 64; see FIG. 11. A winch and drive motor subassembly is suspended from the beam channel 20 and is carried by the channel via two pairs of wheels 66 similar to those associated with the movable leg assembly 16. Since the winch support wheels 66 are downwardly loaded in use, they ride on the upper ends of the inwardly and upwardly turned lips 40 at the bottom of the channel 20, rather than against the inverted U-shaped insulator 50 in the upper portion of the channel.

Figure 8:
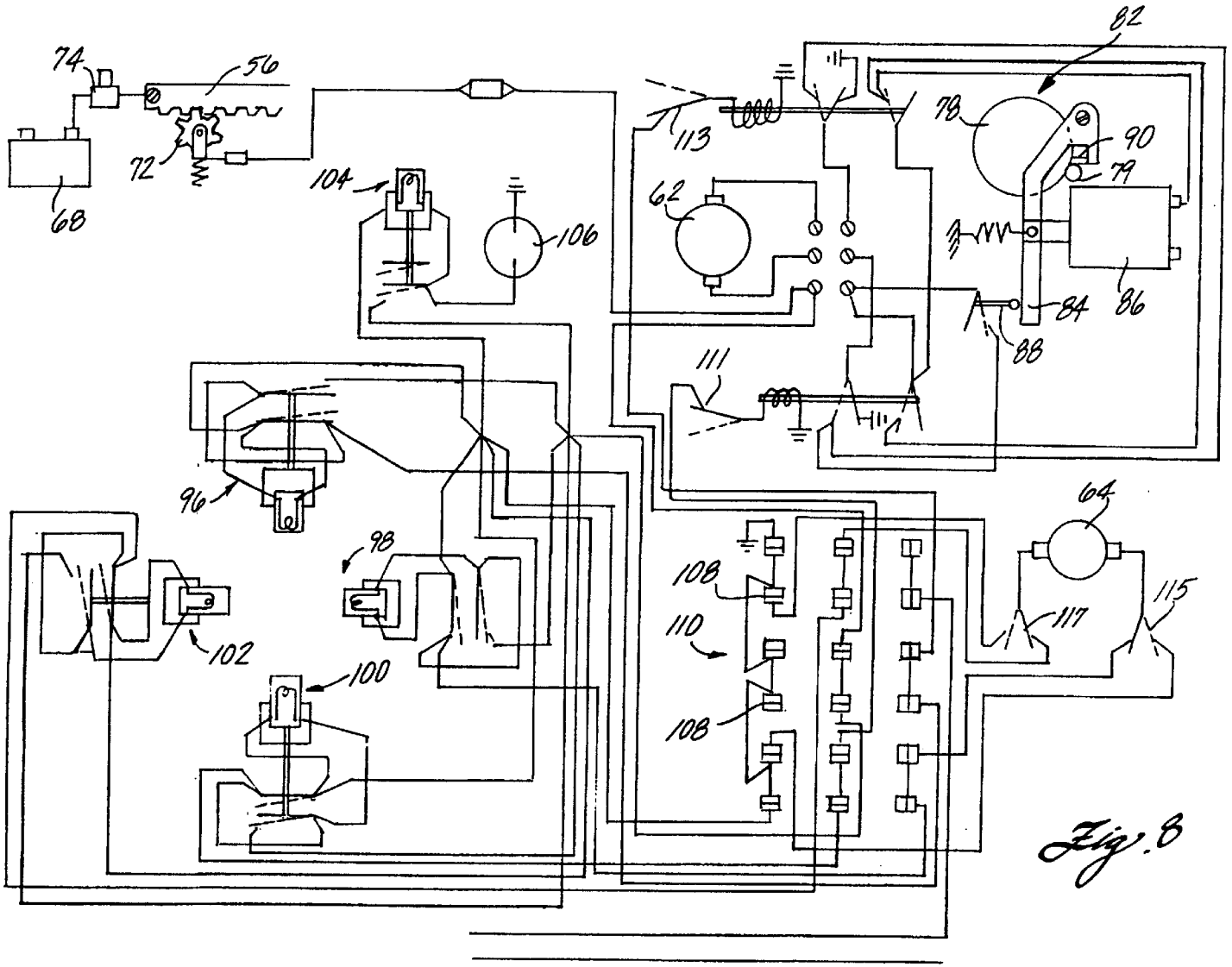
FIG. 8 is a schematic diagram which depicts a control system for the transporter.

A battery 68, preferably a rechargeable 12 volt DC gel-type battery, is carried in a housing 70 in the upper portion of right leg assembly 14 as shown in FIG. 2. The positive terminal of that battery 68, as shown in the schematic diagram of FIG. 8, is connected to the right end of the rack 56 carried within the short length of beam channel 30. The movable winch assembly 58 includes a conductive follower gear 72 which is spring-loaded into contact with the electrically energized rack 56. The follower gear 72 is otherwise electrically isolated from the metallic structural and other components of the winch assembly 58, but is connected through a fuse 74 in the housing 60 to separate lift and horizontal drive motors 62, 64 and their controls and switches. The reversible lift motor 62 is coupled via suitable gears 78, 80 to a pair of horizontal ballscrews 76 which are driven, preferably in series, by the lift motor 62 via the gearing. The winch lift motor 62 drives an input pinion 79 which is meshed with a larger input gear 78 with which can be associated a fail-safe brake mechanism 82 as shown in the upper right portion of FIG. 8 The fail-safe brake mechanism 82 includes a pivoted brake lever 84, the position of which is controlled by a brake solenoid 86. The position of the brake lever 84 can be sensed by a safety switch 88. The brake lever 84 carries a pawl 90 which engages the input gear 78 whenever the lift motor 62 is not energized. The lift motor 62 cannot be operated to raise or lower a person supported in the transporter until the brake solenoid 86 is operated to disengage the brake lever pawl 90 from the input gear 80. The lift motor 62 preferably is located at the left end of the housing 60. Manually operable switches are provided that can be operated to control the operation of the transporter's motors.

A control box is associated with the hoist and channel assembly 26. The control box can carry 5 lamp-illuminated push button switches 96, 98, 100, 102, and 104. Four of those switches 96–102 are arranged at 12, 3, 6 and 9 O'clock positions in the central area of the box face. The upper and lower switches 96, 100 in that array control the upward and downward operation of the lift motor while the left and right switches 98, 102 in that array control left and right traversing operation of the horizontal drive motor. The fifth switch 104 on the control box operates a buzzer 106 or other signaling device so that a person supported in the transporter, if unattended, can signal a need for assistance. Those five illuminated push-button switches are shown in the left portion of FIG. 8.

The elements 108 shown in a 3×6 array in the bottom portion of the right half of FIG. 8 represent a terminal block 110 which is useful to make desired electrical connections within the winch housing 60.

Figure 12:
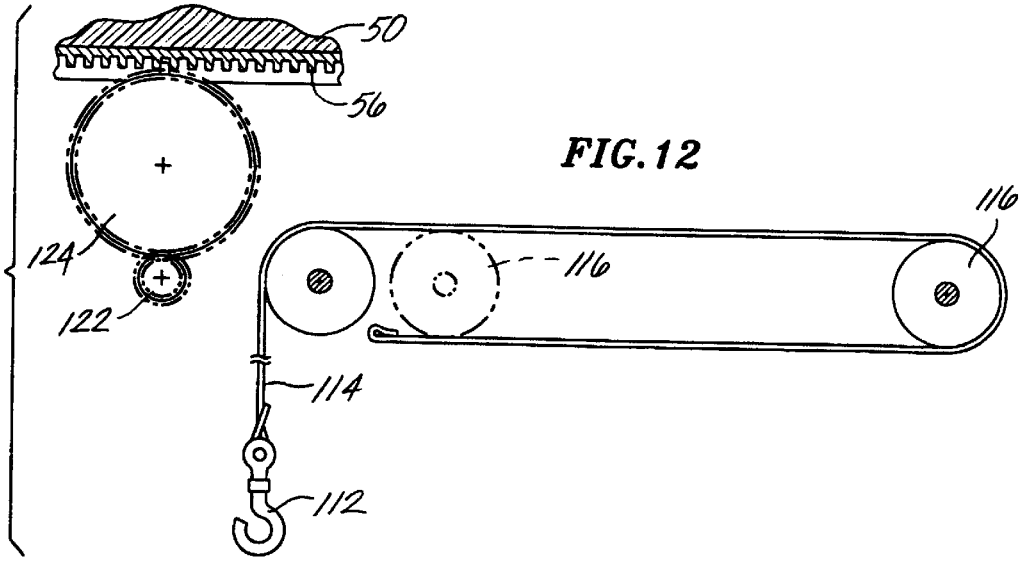
FIG. 12 is a schematic view which, in general ways, depicts the basic operations of the winch illustrated in FIG. 11.

As shown in FIGS. 1, 2, 5 and 6 the transporter includes a lifting hook 112 which is preferably carried on the free end of a length of strong, load-carrying flexible (fabric) strap 114. The upper dead end of that strap 114 is fixed within the winch housing 60 as illustrated in FIG. 12. From its fixed en within housing 60, the strap 114 passes around the bottom, right side, and top of a traveling pulley 116 and then leftward to the top and around the left portion of a fixed axis pulley 118 before extending downwardly from housing 60 to the lifting hook 112. The fixed axis and traveling pulleys 116, 118 within the winch housing are located between two horizontal parallel ballscrews 76 which, as noted above, are driven by the lift motor 62 through suitable gearing 78, 80. The opposite ends of the axle for the traveling pulley 116 are carried by respective ones of a pair of ballnut assemblies 120 which are engaged with the respective ballscrews 76. When the traveling pulley 116 is located close to the stationary pulley 118, hook 112 is located most downwardly below housing 60. As the ballscrews 76 are operated in synchronism to move the traveling pulley 116 rightwardly away from the stationary pulley 118, the hook assembly 112 is raised toward the housing. Limit switches 111 and 113 are operated when the movable pulley is at each of its limits of travel within housing 60 to interrupt operation of winch motor 62.

The output shaft of the horizontal drive motor 64 is connected from a motion reducing gear box associated with that motor to an input pinion 122 which drives a large diameter nonconductive gear 124 (FIG. 12) which rotates about an axis fixed in the winch structure. That gear 124 is meshed with the downwardly facing metal rack 56 carried by the structural channel arrangement described above. The horizontal drive motor 64 preferably is carried on the forward face of housing 60 adjacent its left end; see FIG. 11. Operation of motor 64 is interrupted when the winch carrier or the winch housing moves into contact with either of the leg assemblies of the transporter. Movement of the winch carrier into proximity to the fixed leg assembly can be sensed by a limit switch 115 mounted to the back right end of that carrier as shown in 9. A second limit switch 117 at the opposite end of the winch assembly can detect proximity to the movable leg assembly. See also FIG. 8.

When the longer, hinged channel length 32 of the beam is in its vertical position, shown in solid lines in FIG. 1, the winch assembly 26 is captive between the two leg assemblies 12, 16 of the transporter and cannot move appreciably left or right along the short beam section 30. However, when the long length of the channel 32 is moved to its horizontal position, see, e.g., FIG. 3, the rack 56 carried by the long channel length 32 electrically and mechanically interconnects with the rack 56 in the short channel length 30 to enable the hoist housing 60 to be moved by the horizontal drive motor 64 along the extended top beam 20 of the transporter once either one of two things has occurred. Those things are either manual movement of the movable leg assembly 18 along the extended beam 32 to its extreme left end thereby to support the left end of the beam 32, or engagement of the left end of the extended beam 32 in a suitable support device (described below with reference to FIG. 19) usually in association with disconnection of the removable leg assembly 18 from the transporter as shown, for example, in FIG. 19.

Figure 4:
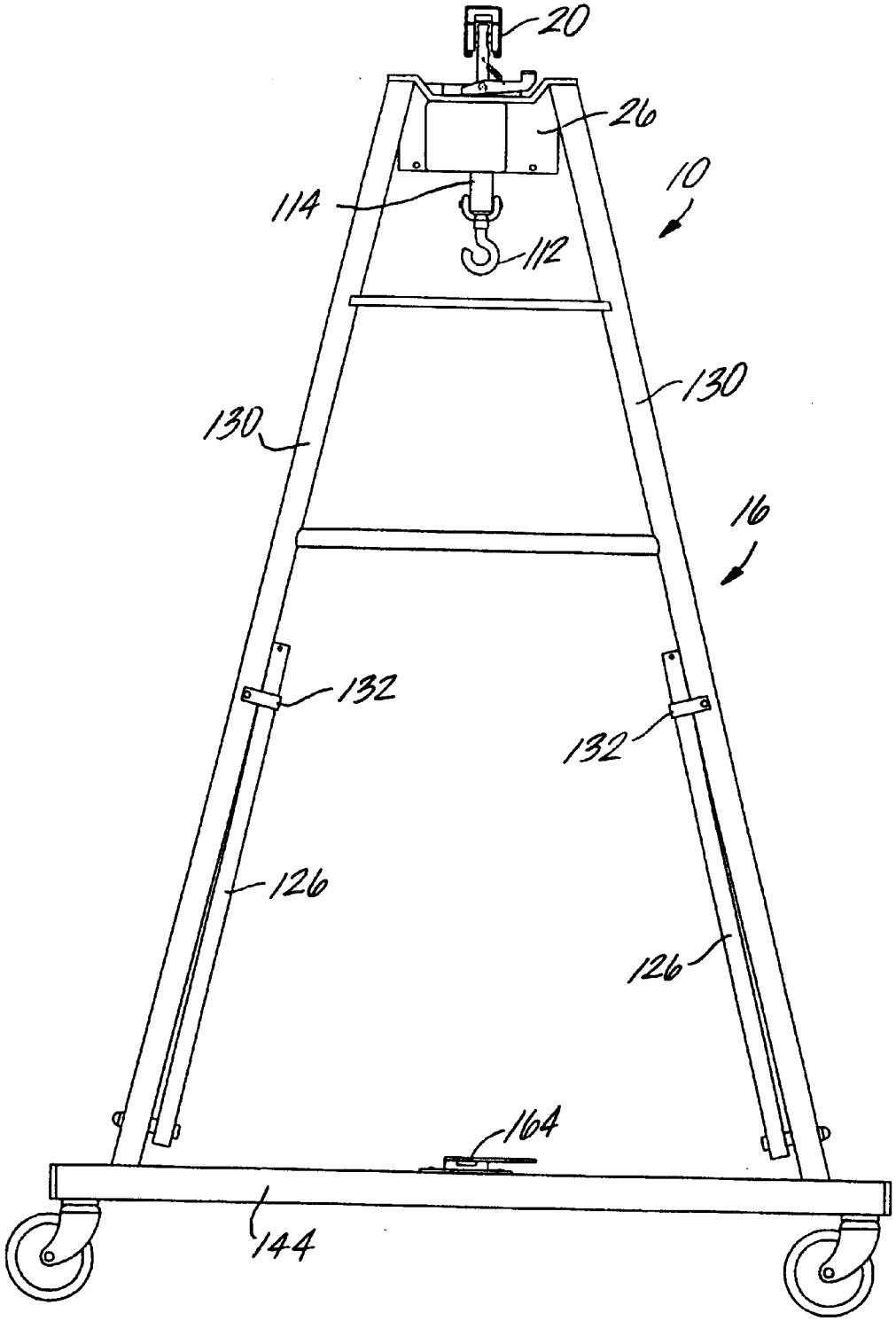
FIG. 4 is a side elevation view of the movable leg of the transporter depicted in FIG. 1.

The two preferably tubular brace members 126 shown in FIG. 4 are hinged at their lower ends to the main vertical, preferably tubular members 130 of the moveable leg assembly 18. Tubes 126 have a stowed position in the movable leg assembly 18, parallel to their adjacent main tubular members 130 and are held by clips 132 in such stowed positions. The unhinged ends of tubes 126 can carry spring-biased latching devices. As shown in FIG. 1, tubes 126 can be swung into latched connections with studs or pins on with the lower portion of the fixed leg assembly 12 in the minimum width state of the transporter. FIG. 4 shows the rear brace tube 126 in its latched position at the rear of the fixed leg assembly 12 and the forward brace tube 126 at a location between its latched and stowed positions. Headed pins 136 (FIG. 27) (conveniently defined by bolts) with which the movable ends of brace tubes 126 cooperate are provided in the fixed leg assembly 12. The brace tubes are advantageously connected between the lower ends of the movable and fixed leg assemblies in the minimum-width state of the transporter when the transporter is being moved from place to place. During those times, the cross braces 126 impart strength and stability to the lower portions of the transporter and prevent the lower ends of the leg assemblies 12, 16 from moving undesirably toward or away from each other as the transporter is moved from place to place on its castered support wheels 138. Obviously, brace tubes 126 must be in their stowed positions in the movable leg assembly when the movable leg assembly 16 is any position other than its minimum-width position relative to the transporter's fixed leg assembly 12.

The form of the transporter shown in FIG. 1 has a single lifting hook 112. Accordingly, that form of transporter is intended to be used with a lifting beam 140 (strongback) and a sling-type support 142 for a person, as shown for example in FIGS. 1 and 2. The sling 142 can be formed of an elongate piece of strong fabric which can be suitably reinforced at the ends of its long edges to receive steel bars. The midlengths of the bars on each side of the sling 142 can be interconnected by a length of chain. A central link in each chain can be engaged with a hook defined at the respective end of a strongback or cross lifting beam 140 which is engaged at its central portion with the lifting hook 112 of the transporter.

Figure 6:
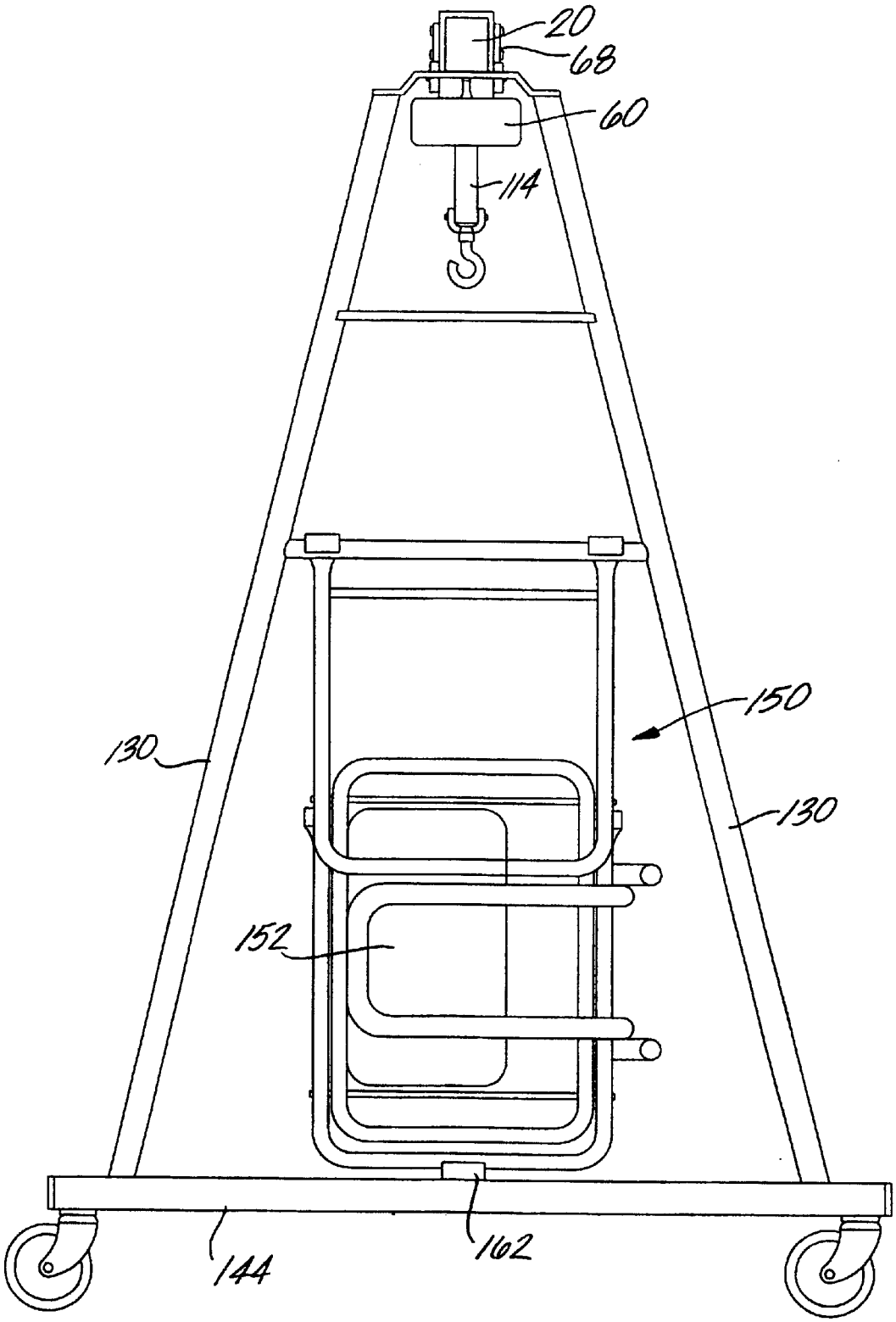
FIG. 6 is a side elevation view showing the seat assembly collapsed and stowed in a leg assembly of the transporter.

FIG. 5 shows the presence in the transporter of a support seat 150 which is shown in its stowed position within the lower portion of the right fixed leg assembly 12 of the transporter. That seat assembly 150 is shown in its deployed position between the fixed and moveable legs 12, 16 of the transporter in FIG. 5. The seat assembly 150 has a back 152 which is hinged to the rear portion of a seat member 154. The seat assembly can be kept in its collapsed position, FIG. 6, by a retainer strap which is carried by the rear lower portion of the seat back and which, in the particular transporter shown in FIG. 5, carries at its free end a snap member. When the seat assembly has been collapsed for stowage in the transporter, that snap can be engaged with a cooperating snap element carried on the under side of the seat member 150 adjacent its forward edge. FIG. 6 shows that when the seat assembly 150 is properly stowed in its collapsed state in the fixed leg assembly 12, the lower end of the seat assembly 150 is held in position by a retainer 162 on the upper edge of the bottom fore and aft member 144 of the fixed leg assembly 12.

It is seen, therefore, a transporter of this invention, whether or not it is of the type having a single lifting hook or dual lifting hooks, can provide a seat assembly 150 or other structure connected between the leg assemblies 12, 16 onto which a person can be placed in a secure manner. As a consequence, the person for whose benefit the transporter is provided can have a stable support position in the transporter which is substantially fixed within the transporter, instead of being subject to back and forth or lateral swinging motion or twisting motion while that person's weight is carried entirely by the lifting hook means of the transporter. The provision of a stable seating position for a person within the transporter is a particular feature of a transporter according to this invention.

As noted above, FIG. 3, shows a transporter of this invention, more specifically the transporter of FIG. 1, in its expanded-width state in which it is placed to span across a bed and across an adjacent space next to the bed which is sufficiently wide to accommodate a wheelchair or other chair. The bed surface is defined to receive the patient positioning system (PPS) shown in part in FIG. 20. That patient positioning system and a second form of a transporter positioning system according to this invention are discussed below.

FIG. 5 shows the hinge connection between the upper end of the long channel length 32 and the left end of the short channel length 30 which then forms the top beam of the compacted transporter. FIG. 5 also shows the preferably leaf spring-type resilient latch member 164 which is carried by the short channel length 30 and which cooperates with a pin 166 (bolt head) which projects forwardly from the long channel length's hinge structure 168. Latch member 164 and pin 166, when in their engaged relation, are able to hold the long channel length 32 in essentially collinear relation with the short channel length 30 before movement of the movable leg assembly 16 along the extended beam.

An openable cover 15 provided in association with a charging port in the front surface of the short channel length 30 at its extreme right end. The cover to that port is spring biased into its closed position. When moved to its open position, access is provided for connection of an extension cord, or the like, to a connector within the transporter so that power for charging the transporter's onboard battery 68 can be used to advantage.

Figure 7:
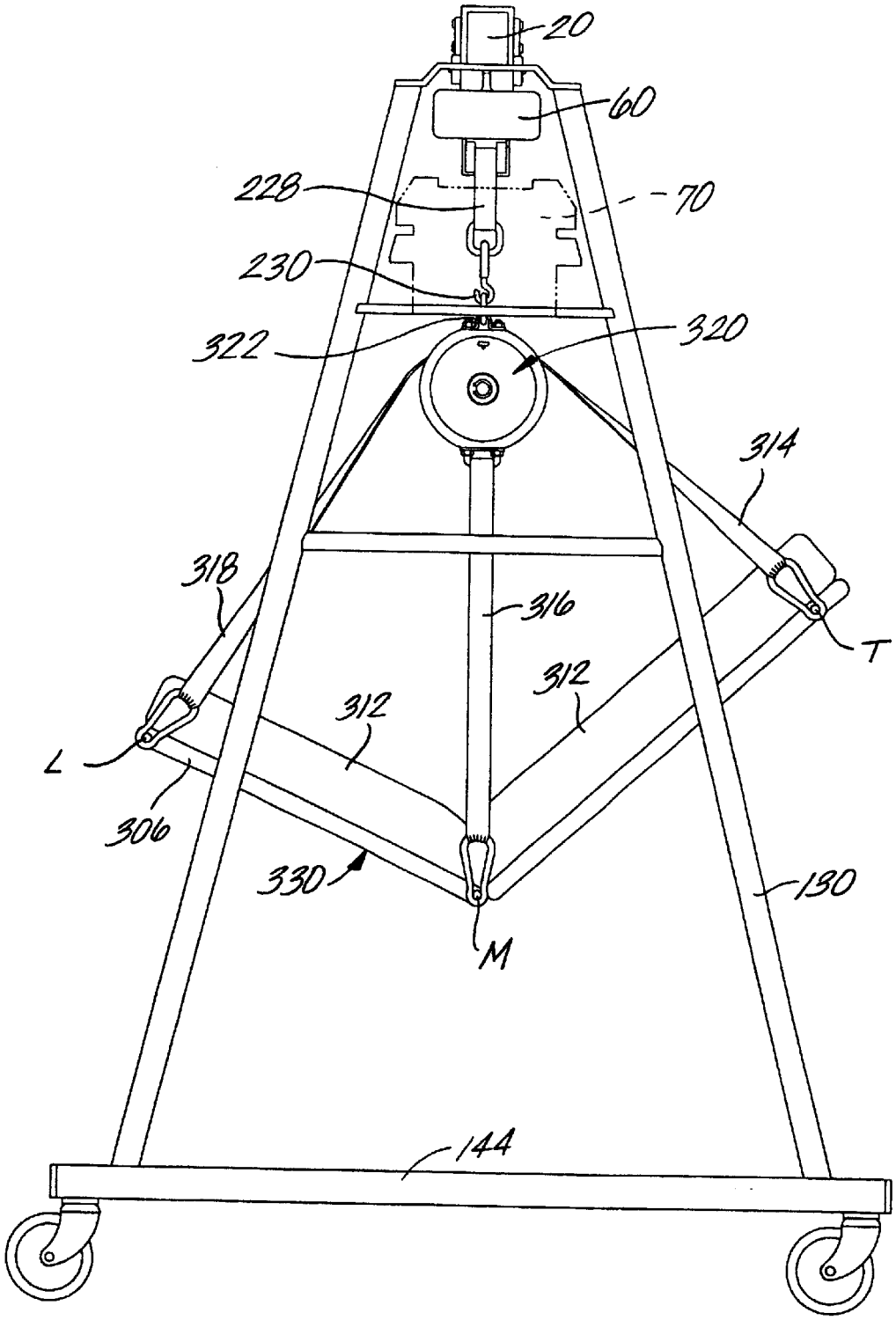
FIG. 7 is a side elevation view of the transporter showing an articulated, positionally adjustable personal carrier suspended in the transporter.

FIG. 7 shows the housing 70 for the on-board battery 68 on its support plate 172 between the upper portions of the main vertical members of the fixed leg assembly 12. There is a circular opening 174 (FIG. 10) in the right end of the hoist housing 60. That opening provides access to the adjacent face of a central gear 80 which is meshed with gears 78 carried at the right ends of the two ballscrews 76 within the hoist housing 60. That accessibility of that gear 80 through the right end of the hoist housing 60 enables a crank to be engaged with the gear face to manually operate the hoist mechanism in the event that such operation should become necessary.

FIG. 1 shows the connection between the short and long channel lengths 30, 32 in the stowed position of the long channel length 32. The long channel length 32 is held at its lower end in its stowed position by a keeper mechanism 178 shown in the lower portion of FIG. 4.

FIG. 16 shows a spring loaded pivoted latch lever 182 which is carried by the left end of the carrier member 42 which connects the upper end of the movable leg assembly 16 to the track defined within the aligned channel lengths 30. 32. That latch 182 cooperates with the hinge mechanism 180 which connects channel lengths 30 and 32. When the channel lengths have been moved into collinear relation. their hinge components provide a pair of aligned slots directly below the hinge pin. The latch member is biased by a spring 181 so that it automatically engages in those aligned slots. Until that latch 182 is released by pressing down on the free forward end of the latch lever 182, the movable leg assembly 16 cannot be moved away from the fixed leg assembly 12. FIG. 16 shows that latch lever 182 in its engaged state.

Figure 19:
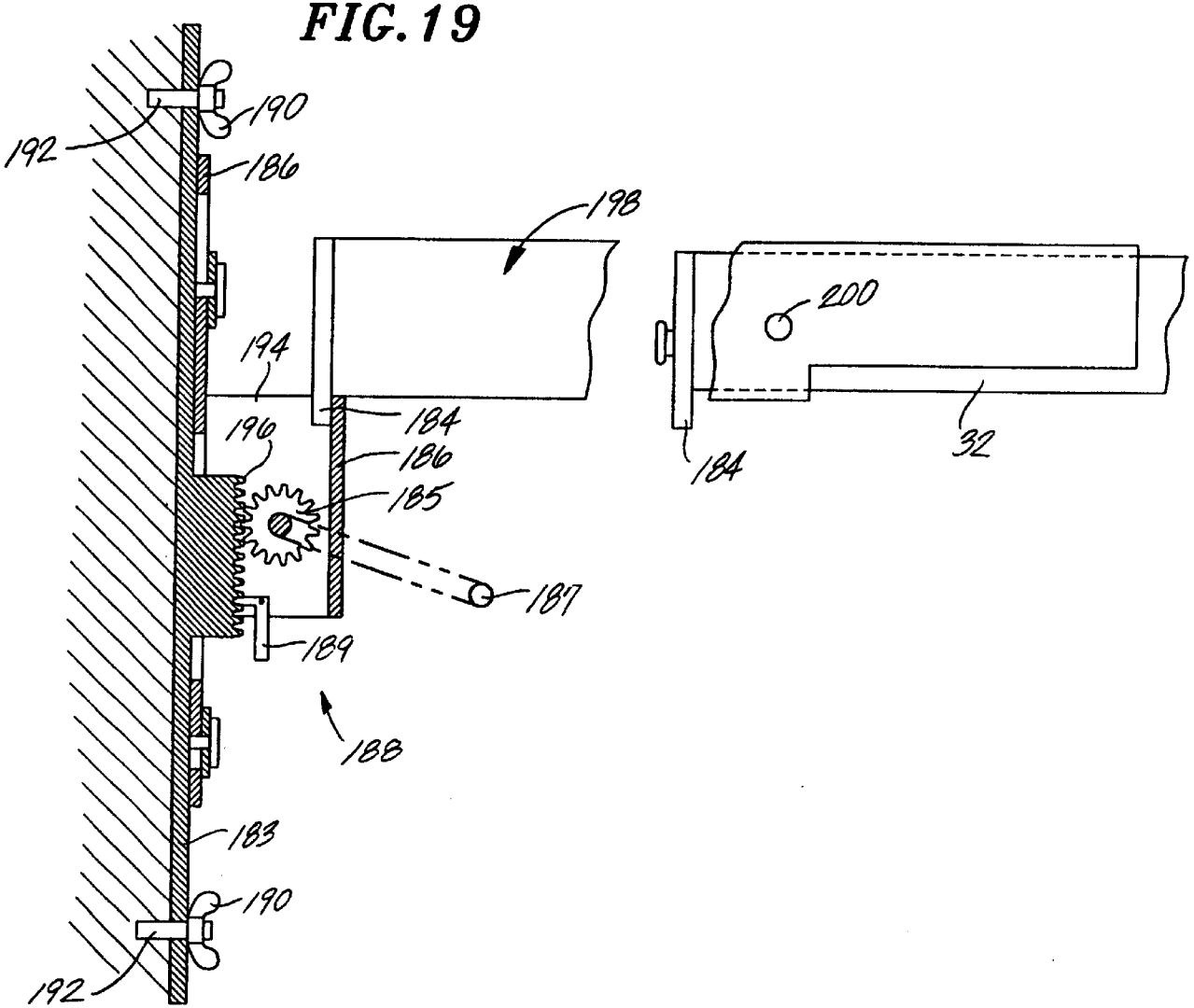
FIG. 19 is a fragmentary elevation view, partially in cross-section, of an accessory by which an extended beam of a transporter of the type shown in FIG. 1 can be supported apart from the movable support leg of the transporter.

FIG. 19 shows the structure at the free or swingable end of the long channel length. The headed pin (such as a bolt head) visible there can cooperate with a retainer mechanism located in the center of the bottom horizontal member of the movable leg assembly to hold the bottom end of the retracted beam extension. FIG. 19 shows that when the long channel length 32 is in its horizontal position, there is a lip-like projection 184 below the lower edge of the channel 32, front to back across the extreme end of the channel 32. That projection 184 can cooperate with a vertically adjustable member 186 of a wall-mount accessory 188 for the transporter. The wall-mount accessory 188 as shown in FIG. 19 is mounted to a vertical surface by two-wing nuts 190 which cooperate with threaded studs 192 fixed to the vertical surface. The studs secure a base plate 183 to the vertical surface. The base plate carries a vertical rack 196 which projects through a slot in a slide plate 186 which is captive to the base plate and is slidable longitudinally (vertically) along the base plate through a limited range of movement. The slide plate defines a hollow, upwardly open receptacle 194 in its central portion where the slide plate mounts an axle to which is secured a gear 185 which is meshed with rack 196. A crank lever 187 is connected to the gear axle outside receptacle 194. A pawl tooth of a latch lever 189 is releasably engageable with the rack adjacent gear 185.

FIG. 19 shows a depending end lip 184 at the end of an extension 198 for the long channel length 32. The extension end lip 184 is engaged in receptacle 194 of the wall mount accessory so that the accessory's movable support member 186 supports the free end of the extended long channel length 32. That is, either the unhinged end of channel length 32, or the end of an extension for that channel length, can be supported by the wall mount accessory. The rack mechanism 196 of the wall-mount accessory 188 is provided so that the accessory's movable support member 186 and the adjacent end of the transporter load beam can cooperate to support the left end of the beam independently of the movable leg assembly 16. That is, by use of the wall-mount accessory 188, a load supported in the transporter can be carried by the wall-mount accessory 188 and the fixed leg assembly 12 and only slightly or, preferably. not at all by the movable leg assembly 16. As a consequence, the movable leg assembly 16 can be completely removed from the transporter so that the transporter can be used to move a person into a support position on. e.g., a sofa disposed against a wall. To move a person into a support position on a sofa, the wall-mount accessory can be installed on a wall above the back of the sofa. If the wall-mount assembly is not in use, the studs mounted in that wall to receive the wall-mount accessory can be covered by a photograph or a painting for example.

As noted above. FIG. 19 shows the use with the long channel length 32 of an extension member 198 which has one pinned connection 200 to the free end of the long channel length 32 and which is engaged at its opposite end 202 with the wall-mount accessory 188. FIG. 19, therefore, shows the ability of a transporter according to this invention to be used in a situation where the transporter needs to span a distance greater than the combined length of the long and short channel lengths 30. 32 in order to place a person carried by the transporter in a desired location, such as within a spa.

Figure 17:
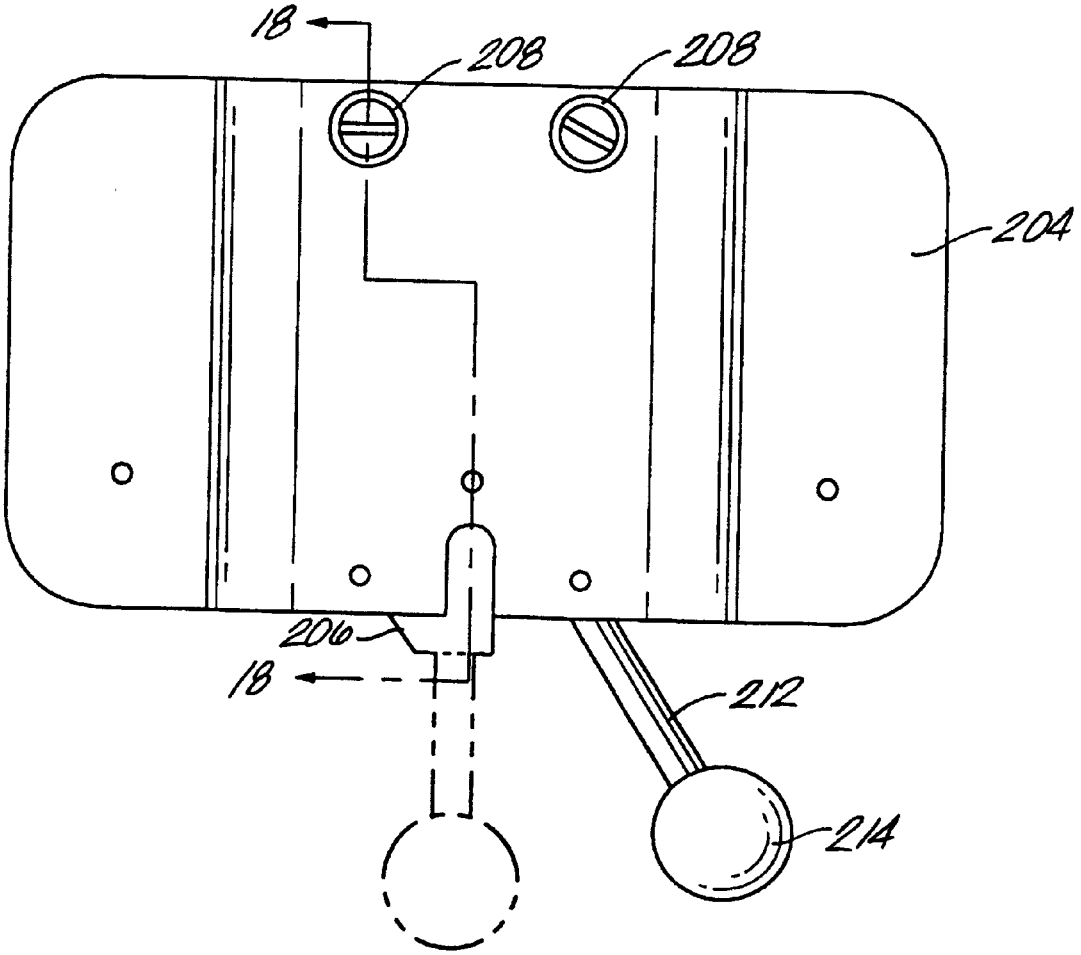
FIG. 17 is a top plan view of the coupling plate at the upper end of the movable leg shown in FIG. 4.
Figure 18:
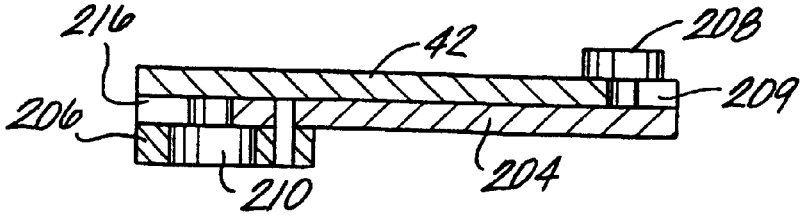
FIG. 18 is a cross-section view taken along line 18—18 in FIG. 17.

FIG. 17 is a top view of the top plate 204 of the movable leg assembly 16 as disconnected from its carrier 42 which is captive to the transporter horizontal beam structure. A cam-action lock mechanism 206 is used in combination with two headed pins 208 carried by that top plate 204 and with a third headed pin 210 carried at the underside of the carrier 42 for the movable leg assembly 16; see FIG. 18. The cam action lock 206 is operated by a lever 212 having a suitable handle 214 at its free end. FIG. 17 shows that the handle 214 can be of ball-like configuration. That lock mechanism 206 is shown in its closed condition in FIG. 18 and in its open condition in FIG. 17. When the lock mechanism is in its open state, it enables the headed pin 210 depending from the carrier 42 to disengage from a slot 216 in the central left edge of the movable leg assembly's top plate 204 and to enable the headed pins 208 carried adjacent the right edge of the top plate 204 to disengage from cooperating slots 209 defined in the right portion of the bottom surface of the carrier 42. Thus, when the movable leg assembly 16 of the transporter has been relieved of vertical load in the manner described above, the movable leg assembly 16 can be disconnected from its carrier 42 in the manner discussed above. The movable leg assembly 16 can then be moved out of the way and left standing in an essentially vertical position by use of a kick-stand arrangement. The kick-stand can be carried by the bottom fore and aft member 144 of the movable leg assembly 16.

An expandable utility lifter (EUL) version of a PPM according to this invention can differ from transporter 10 in the nature of the winch mechanism which is movable along the upper horizontal beam structure of the EUL. Also, an EUL need not (usually will not) include the features (such as the stowable seat arrangement of FIGS. 5 and 6) of transporter 10 which are relevant to the handling or the comfort of a person. A commercially available, electrically powered winch, mounted in a suitable carrier which is supported in the manner described above by wheels which engage the upwardly open rail surfaces at the bottom corners of a beam channel length, as described above, can be components of a EUL. An EUL can incorporate a folding extensible beam arrangement as described above.

The foregoing descriptions have been presented with references to a transporter having a winch arranged to raise and lower a single cable or strap. It is believed that with the accompanying drawings, a person of ordinary skill in the pertinent art has adequate information and instruction to replicate, to approximate, or to modify the transporter described herein to this point. Also, in view of the content of the accompanying illustrative and the following remarks herein, that person will be able to replicate, approximate or modify the dual hook hoist assembly and the PPS and its related structures.

Figure 13:
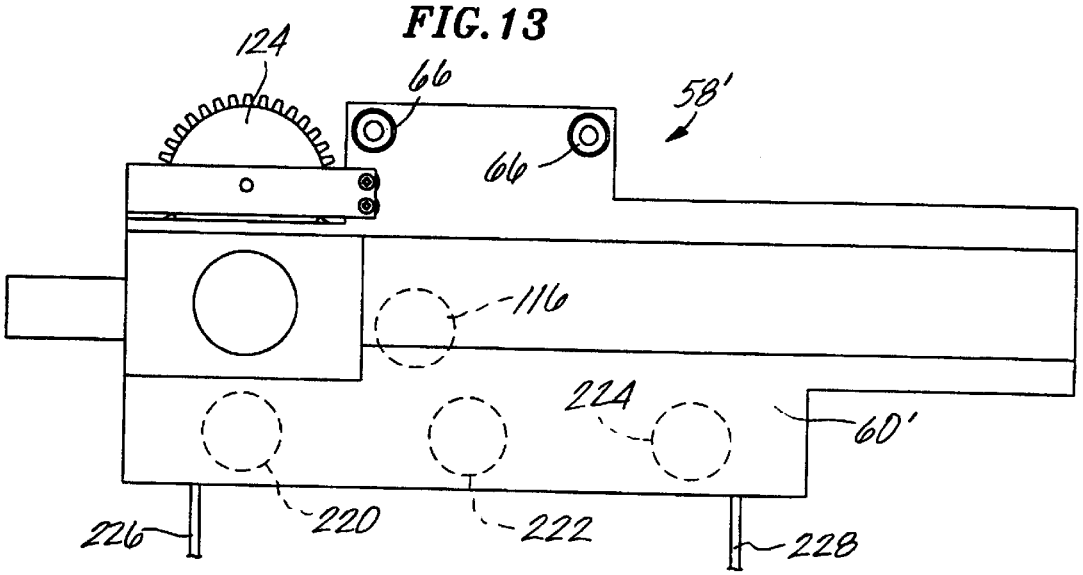
FIG. 13 is a generalized elevation view, similar to FIG. 11, of another winch arrangement useful in a transporter according to this invention.
Figure 14:
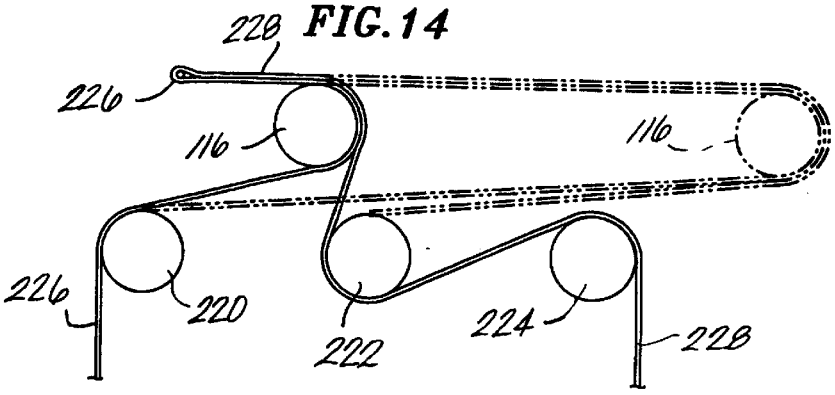
FIG. 14 is a schematic view which generally depicts the way the winch shown in FIG. 13 operates to take in and pay out a pair of flexible load carrying elements.

As shown in FIGS. 7 and 13–15, for example, a presently preferred transporter according to this invention is one which has two laterally spaced points of support for a person. Such a form of the transporter is referred to as a dual lift-point transporter which is most advantageously used with the patient positioning system. The winch arrangement 58' shown in FIG. 13 incorporates the traveling pulley 116 and its ball screw drive mechanism 76 as described above and as shown in FIGS. 9 and 10 for example. The winch arrangement 58' of FIG. 13 does not include a fixed axis pulley located between the ball screws. Instead, it incorporates three fixed axis pulleys 220, 222, 224 mounted in the winch assembly 58' in a common horizontal plane located below the plane of the ball screws 76. A pair of load-carrying flexible straps 226, 228 have upper ends affixed to the winch frame adjacent the 10 O'clock position of the traveling pulley 116 in its left-most position. Those two straps 226, 228 pass around the top, right, and bottom portions of the traveling pulley 116, from which one of those straps 226 passes to the top and left side of the left-most fixed axis pulley and 220 then downwardly from the winch housing 60'. The other strap 228 passes from the traveling pulley 116 around the left side of the central fixed axis pulley 222 and then over the top and down the right side of the right-most fixed axis pulley 224 from which it exits downwardly from the winch housing 60'. The lower end of each strap 226, 228 is connected outside the winch housing to a lift hook 230. Accordingly, it will be seen that the hoist arrangement 58' illustrated in FIG. 13 is a dual-strap, dual-hook hoist which is operable to synchronously raise, or to lower, two lift hooks 230 associated with the left and right ends of the hoist assembly. Those two lift hooks 230 can be used with the sling assembly shown in FIG. 1, for example, or with any other acceptable patient supporting device which may be available or convenient. Because a person supported by the dual-strap winch assembly has two points of support from the transporter, such a person experiences a greatly reduced tendency to twist in the transporter about a vertical axis, as compared to what would be experienced by the person supported from a single lift point by a conventional personal hoist.

A transporter incorporating a dual-strap winch assembly according to this invention is advantageously used with the patient position orienting system 300 (PPS) which is shown in FIGS. 7 and 20–23. The head end 302 of the PPS is at the right end of the illustrations of FIG. 23. The support structure for the PPS is preferably fabricated of metal tubing which is formed into a series of loop-like frames which are connected to each other at hinge axles H1, H2 and H3 which extend across the width of the PPS support frame. As shown in FIG. 7, the PPS also includes pads 312 which are carried by the hingeably interconnected sections of the PPS frame.

Figure 20:
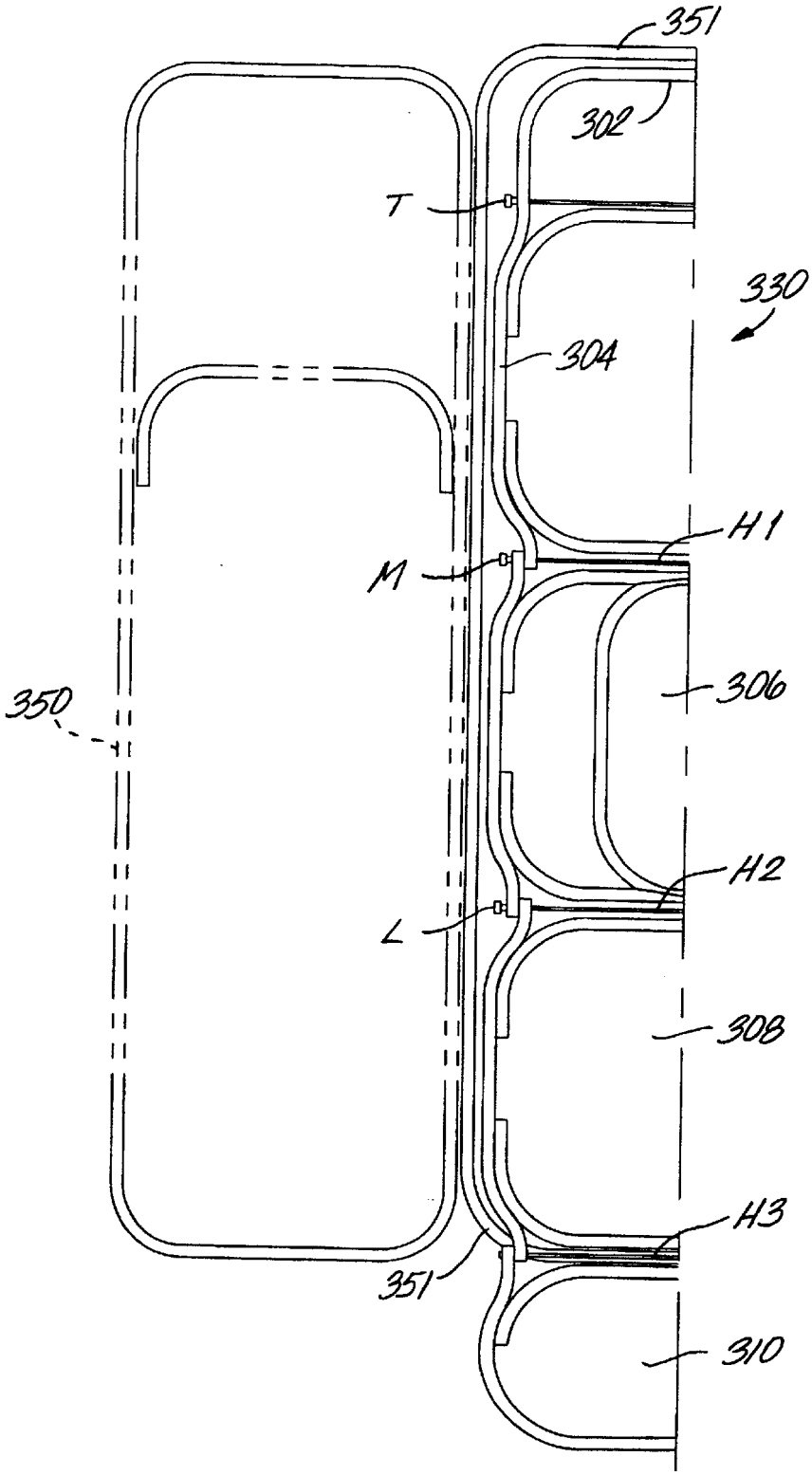
FIG. 20 is a plan view of the left-half of a bilaterally symmetrical frame for an articulated personal carrier of the kind shown in FIG. 7.

The PPS has a torso (back) and head frame section 304, a central or seat frame section 306, a leg frame section 308 and a foot frame section 310. Those several sections of the PPS support framework are hingeably interconnected as noted above and as shown in FIG. 20. The ends of the hinge axles H1 and H2 which interconnect the torso and head and seat portions 304, 306 and the seat sections 306 and leg sections 308 of the PPS frame provide middle M and lower L lift point along each side of the PPS frame. The third lift point T at each side of the PPS frame is provided by the headed end of a transverse pin through the torso and head section 304 of that frame as shown in FIG. 20. Those lift points preferably are used with a set of three support straps 314. 316, and 318 which are associated with a dual drum hub assembly 320. Each dual-drum hub assembly 320 is in turn supported by a lift hook 322. of the dual-strap winch assembly. It is apparent therefore, that there are two dual-drum hub assemblies 320 in the connection between the dual-strap hoist assembly and the PPS structure. One dual-drum hub assembly is associated with each side of the PPS.

Figure 23:
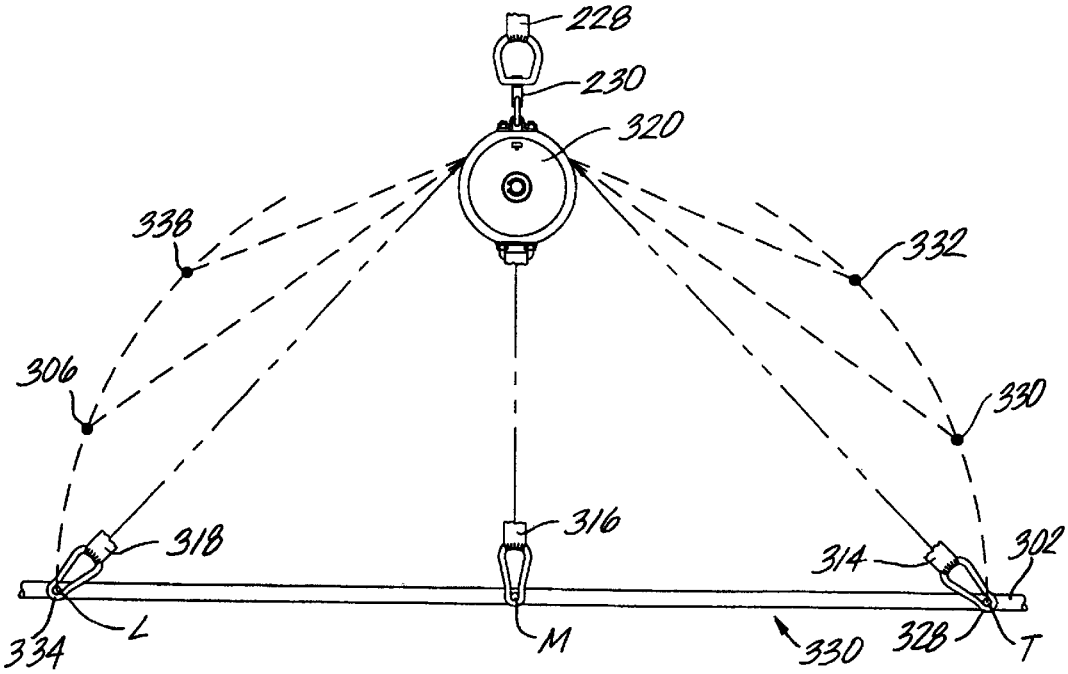
FIG. 23 is a simplified elevation view showing how a frame of the kind depicted in FIG. 20 can be lifted by a winch of the kind depicted in FIGS. 13 and 15 by use of an adjustable harness system.

As shown in FIG. 23, a load carrying strap 316 is connected at one end to the lower part of the hub assembly 320 and at its lower end to the middle lift point M of the PPS frame via a loop, hook or other suitable element engageable with the end of the hinge pin H1 which interconnects the seat and torso/head sections of the PPS frame.

Figure 25:
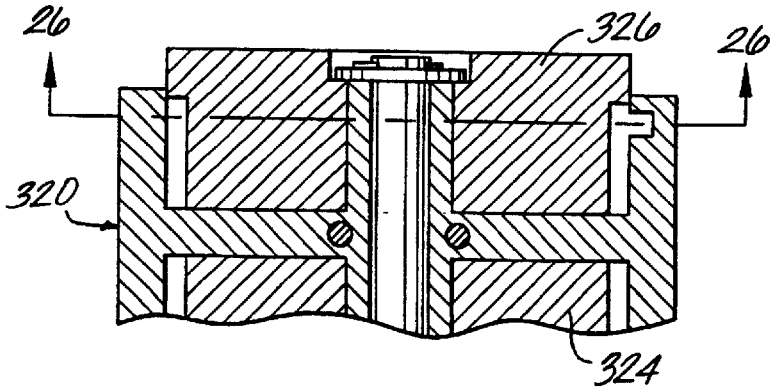
FIG. 25 is a cross-section view taken along line 25—25 in FIG. 24.

As shown in FIG. 25, the dual drum hub assembly 320 includes two coaxially mounted drums 324, 326 with each of which there is associated a respective load carrying strap 314 or 318. Strap 314 extends from its drum 324 into connection with the top lift point T at the head end of the PPS as shown in FIG. 23. The strap 318 associated with the other drum 326 extends from its drum to the PPS lift point L provided by the hinge pin H2 which interconnects the seat and leg portions of the PPS frame. Each drum has a plurality of stable positions angularly about its supporting axle in the hub assembly. In the presently preferred form of the hub assembly, each drum has three stable positions 328, 330 and 332. Depending upon which of the stable positions each drum has at any given time, the strap associated with that drum has a different effective length. Accordingly, the strap 314 associated with the head end of the PPS frame has effective lengths productive of stable frame positions 328, 330 and 332 denoted in FIG. 23. Similarly, the strap 318 associated with the other drum 326 has effective lengths which define stable positions 334, 336 and 338 for the lower lifting point L. It will be observed that positions 328 and 334 for the ends of the drum-mounted straps 314 and 318 and the lower end M of the central strap 316 form a straight line; those positions correspond to the stretcher or bed positional arrangement of the elements of the PPS. The two patient supporting sections of the PPS frame which are supported by the three straps extending from the dual-drum hub assemblies allows those PPS sections to be articulated relative to each other into various angular relations as shown in FIG. 23.

The drums 324, 326 of the dual-drum hub assemblies 320 are operated to adjust the effective lengths of the shoulder 314 and knee 318 support straps, preferably before those straps are subjected to load to lift the patient from the initial position of the patient. For example, if the patient is lying flat on the cushions carried by the several sections of the PPS and it is desired to lift that person into a generally seated position, such as shown in of FIG. 7, the effective lengths of the straps 314 and 318 on each side of the PPS are adjusted to the lengths corresponding to the seated position, say positions 332 and 338, either before the lower ends of those straps are connected to the respective lift points or after connection of the strap ends to the lift points but while the straps are slack. Therefore, as a dual-strap winch assembly is operated to raise the dual-drum hubs, the patient is moved into a seated position before being raised from the surface on which the PPS is initially supported. Conversely the person can be readily, controllably, safely and comfortably placed from a seated position in a suspended PPS into a flat position on a supporting surface such as the central portion of the bed shown in FIG. 3, for example.

Figure 24:
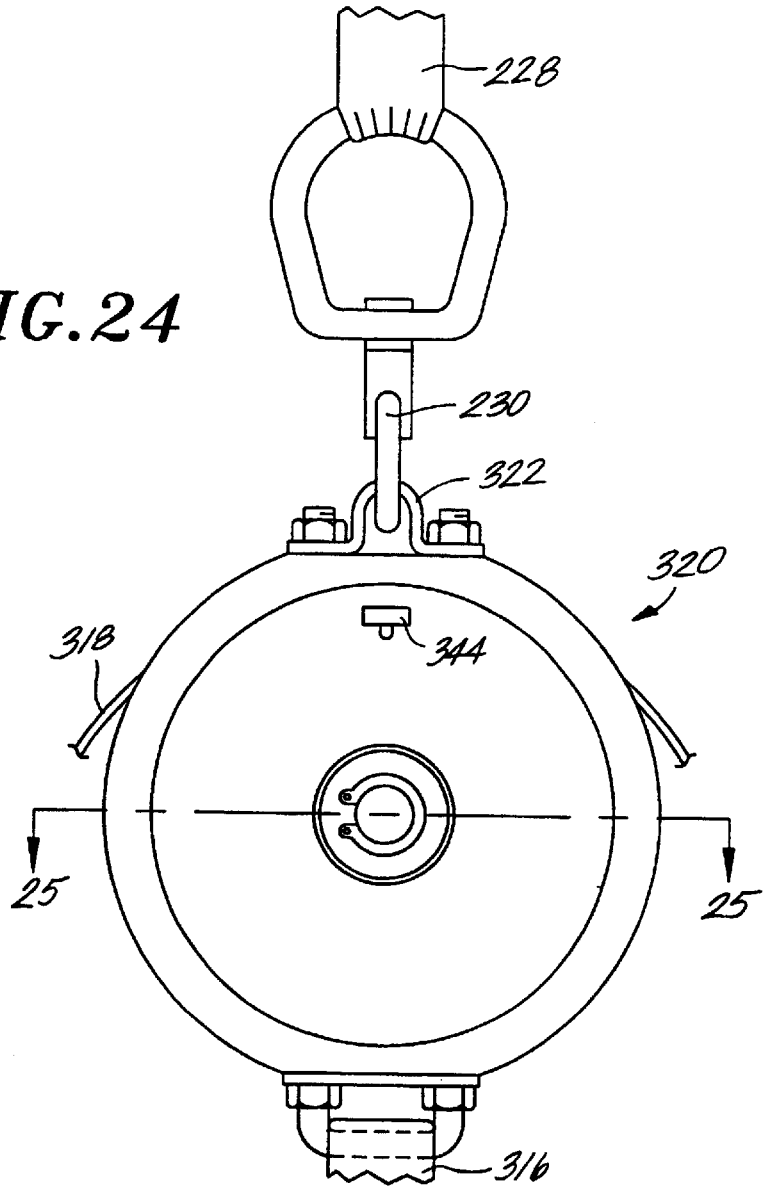
FIG. 24 is an enlarged side elevation view of a hub assembly of the harness shown in FIG. 23.
Figure 26:
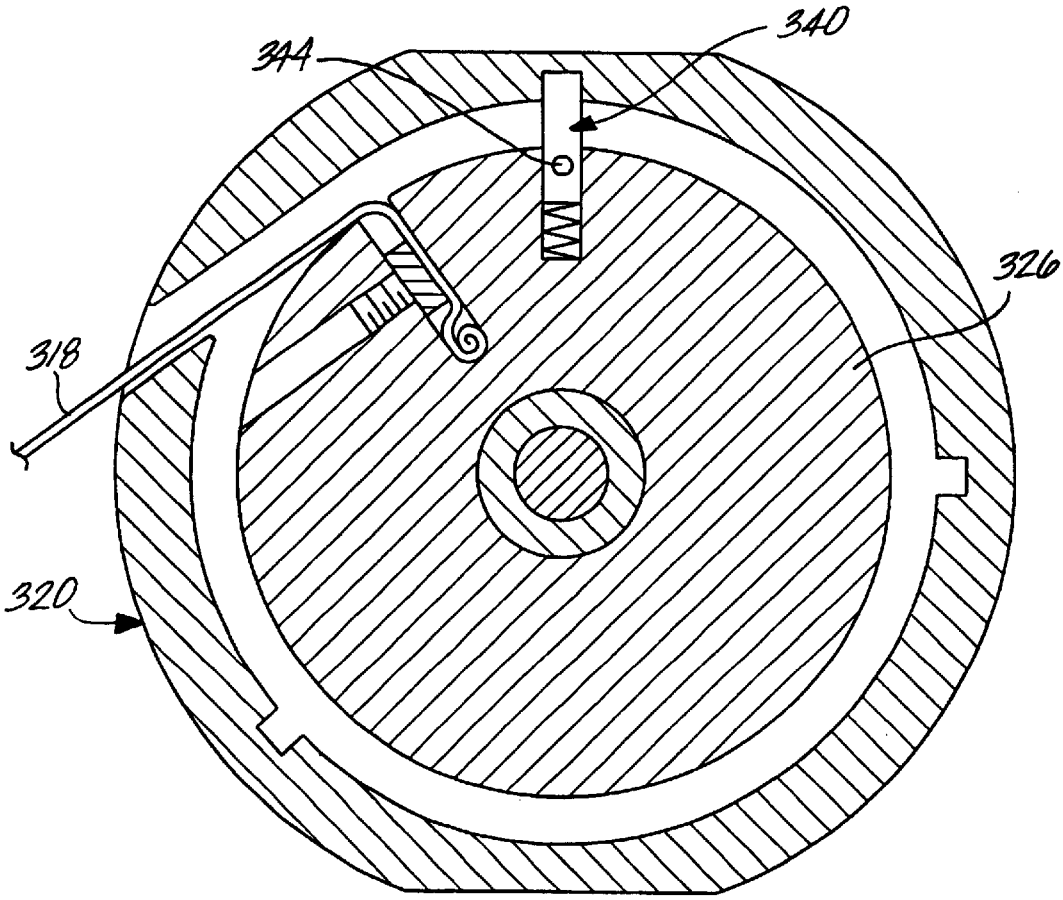
FIG. 26 is a cross-section view taken along line 26—26 in FIG. 25.

As shown in FIG. 26, each drum 324, 326 of a dual-drum hub assembly 320 is secured in a desired angular position in the assembly by a manually operable detent mechanism 340 provided for each drum. If the drum is at one of its several stable angular positions 328, 330, or 332 in the assembly, the detent mechanism 340 locks the drum 324 at that position by action of a spring arrangement 342 which is a part of the mechanism. The detent mechanism 340 can be released from such a locked state by depressing an accessible actuator 344 for that drum. Also see FIG. 24. The drum can be turned between its stable positions only when that actuator 344 is depressed. Angular adjustments of the drums in the hub assemblies are made while the straps connected to the drums are slack, i.e., are not subject to axial load.

The leg and foot sections 308 and 310 of the PPS frame, and the cushions or pads carried by them can be disconnectible from each other and from the adjacent end of the seat section 306 of the PPS frame.

FIG. 20 shows that the frame for the seat section 30 of the PPS frame has an outer loop and a central inner loop. That characteristic of the PPS frame seat section enables that PPS frame section to carry either a cushion which is continuous over the area of that frame section, or a cushion which has a central opening.

Figure 21:
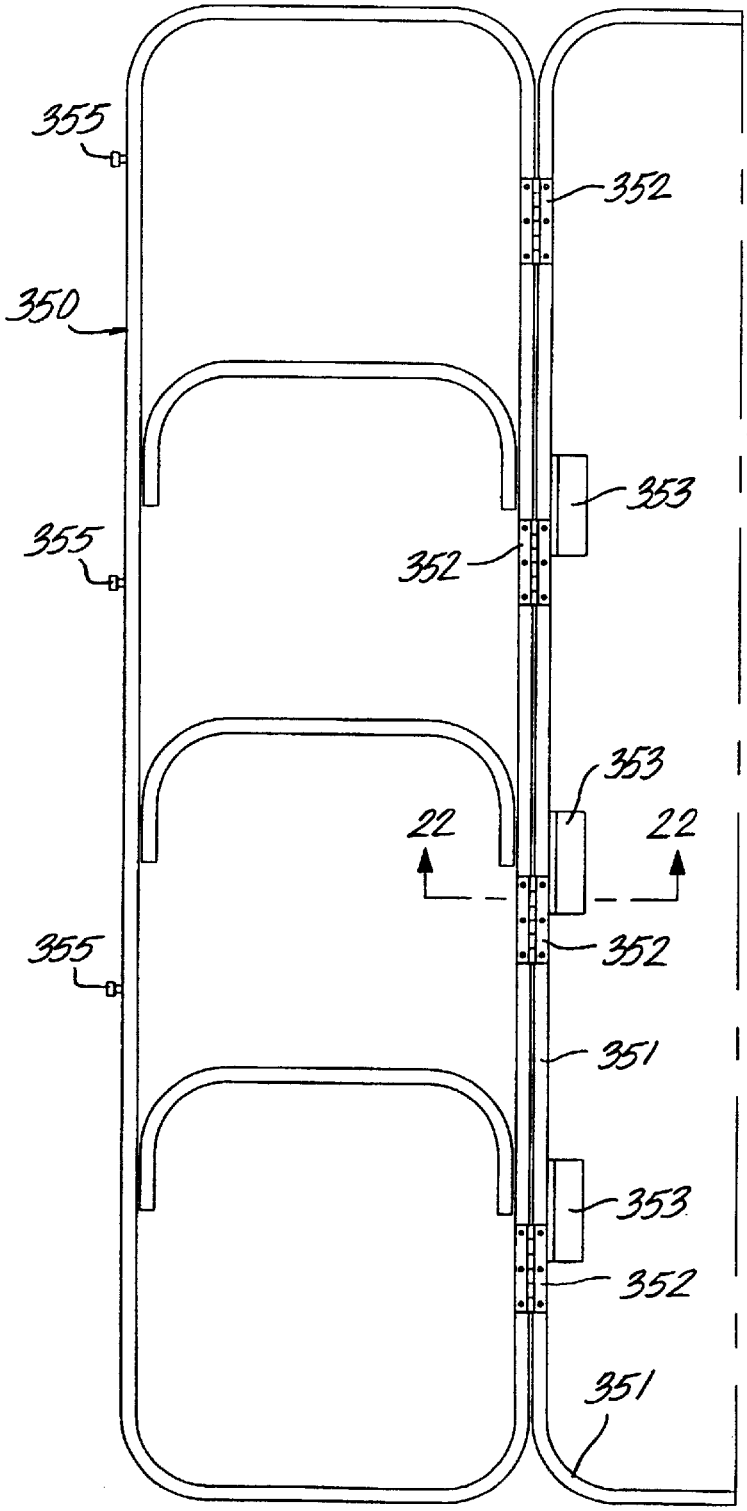
FIG. 21 is a plan view of the left-half of a bilaterally symmetrical base assembly for a bed system, and into which can fit the frame depicted in FIG. 20.
Figure 22:
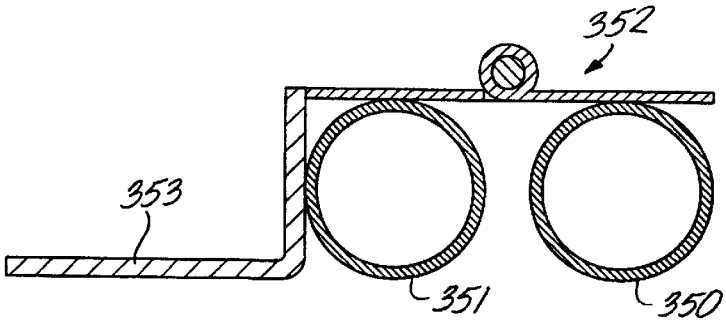
FIG. 22 is a cross-sectional elevation view taken along line 22—22 in FIG. 21.

FIG. 21 (see also FIG. 3) shows that a PPS according to this invention and as described above can be used to define the longitudinal central portion 346 of a bed. That bed central portion is defined by a series of cushions carried by the respective articulated sections of the PPS frame. The left and right longitudinal side portions 347, 348 of the bed each are defined by a single elongate cushion which preferably is supported on respective elongate loops 350 of metal tube, the side portions of which are straight. When the PPS is used as the central portion of a bed, the PPS frame can be placed on a supporting surface within a positioning device which preferably, is a single elongate loop 351 of metal tube. The adjacent tube loops under the elongate side cushions of the bed are hinged 352 at appropriate locations to the PPS positioner loop. To assure proper location of the PPS frame within the positioner when the frame is lying flat on the underlying bed support surface, appropriate portions of the PPS frame sections are received in upwardly open receptacles 353 affixed to the locator 351.

The extreme outer extents of the tube loops underlying the bed side cushions can carry lift points 355 with which the straps associated with dual-drum hub assembly 320 can be connected so that, by use of the winch feature of the transporter, the outer edge of a bed side section can be raised relative to its inner edge. In this manner, the transporter can be used as a power assist device for turning an invalid person on the bed as desired.

If desired, a variation of the PPS which includes a head and torso portion and a seat portion, hingeably interconnected together and carrying suitable pads or cushions, can be used to conveniently move a person supported by the transporter into or out of a vehicle. A provision inside the vehicle is needed to support the adjacent end of the transporter support beam from which the transporter's movable leg assembly will have been removed to enable that transfer function to be achieved.

FIGS. 27 and 28 illustrates a guide arrangement 357 which can be used with transporter to enable one person to move the expanded transporter from a bed-spanning position to a position in which the expanded transporter is sufficiently clear of the bed that the transporter can be reduced in width to its minimum width state. The guide arrangement includes a guide rail 358 which is mounted horizontally to a side of the frame of the bed, in spaced relation to that frame. The guide rail can be tubular in cross-section and preferably extends from near the head of the bed to as close to the foot of the bed as is practicable. Guide rail 358 is placed at an elevation on the bed frame which locates it a short distance above the bottom horizontal brace member 144 in one of the leg assemblies of the transporter, preferably the fixed leg assembly; see FIG. 27.

A guide bracket 360 is slidably mounted to guide rail 358 for movement along the length of the guide rail. The guide bracket, as shown in FIG. 28, can have a modified "Z" cross-sectional configuration which has a flat central web 361 of constant width, an upstanding flange 362 along one edge of the web in a plane normal to the web, and a downward flange 363 along the other edge of the web in a plane normal to the web. The width of the web preferably is modestly greater than the width of the transporter leg assembly's brace 144, as shown in FIG. 28. The guide bracket can be slidably mounted to the guide rail by at least a pair of bearings 364, such as sleeve bearings. carried in mounts affixed to the side of bracket flange 362 which faces away from web 361. The bearings are spaced along the length of bracket flange 362 which preferably has its bed-head end coplanar with the bed-head end of the bracket web, as shown in FIG. 27. The bed-foot end of bracket flange 362 can terminate short of but near the bed-foot end of web 361 which preferably is coplanar with the bed-foot end of bracket flange 363. The bed-head end of flange 363 preferably is spaced a short distance along the bracket from its bed-head end. The length of the bracket is as long as practicable consistent with the structure of the transporter leg assembly bottom brace and with the presence of things which are mounted to the top of the brace. In a preferred transporter which has a collapsible seat assembly stowable in the leg assembly, the leg assembly brace carries atop it at the middle of the length of the brace, a U-shaped receiver 162 for the bottom edge of the stowed seat assembly. In that situation, the length of bracket 360 is slightly less then the distance along the leg assembly brace from that receiver to the vertical member at the end of the brace.

Assume that the transporter is positioned to span the width of a bed on which is a person who is to be lifted from the bed by the transporter and then moved in the transporter through a doorway to another room. The transporter will be in its expanded state, and one of its leg assemblies will be alongside guide rail 358. If the guide bracket is not then engaged with the leg assembly bottom brace in the manner shown in FIGS. 27 and 28, it is rotated about rail 358 from a disengaged and stowed location above the rail into engagement with the brace. When engaged with the brace, the bracket web lies atop the brace, and bracket flange 363 cooperates closely with the side of the brace which faces away from the bed. After the transporter has been operated to lift the person from the bed in a suitable carrier, the person can be moved along the transporter beam to near the transporter leg which is adjacent to guide rail 358. The person operating the transporter can then pull on a transporter leg, preferably the leg with which bracket 360 is engaged, to move the transporter toward the foot of the bed. The engagement of bracket 360 with the transporter leg maintains that leg essentially parallel to the side of the bed, and the transporter rolls parallel to the length of the bed even though force is applied only to one end of the expanded transporter. As the transporter is moved along the bed, the bed-head end of the bracket is contacted by the leg assembly and the bracket thus is driven along guide rail 358 as the transporter is moved toward the foot of the bed. That contact of the transporter leg assembly with the guide bracket can be achieved by an upstanding stop lug 365, carried atop the bracket web, being engaged by the end of the pin 136 provided in the transporter fixed leg assembly for engaging the end of a retractible cross brace 126. When the transporter is being moved from the foot of the bed toward the head of the bed in a bed-spanning condition, the bed-foot end of bracket 360 can be engaged by seat retainer 162 so that the bracket is driven along rail 358 by movement of the transporter.

When the expanded transporter has been moved as far toward the foot of the bed as is permitted by engagement of bracket 360 with the transporter, the transporter will be partially clear of the foot of the bed. The guide bracket is disengaged from the transporter leg assembly, as by use of a convenience handle 366 on the bracket web, after which the transporter is easily moved by one person to a position in which the bed is clear of the space between the transporter leg assemblies. The transporter movable leg assembly then can be moved along the extended beam to its home position on the beam. and the beam can be effectively shortened by hinging the beam extension into its vertical stowed position alongside the movable leg. The cross-braces 126 can be engaged between the lea assemblies, if desired. The person can be lowered onto the transporter seat or be otherwise positionally stabilized in the transporter. The transporter then can be rolled by one person through the doorway into another room.

Figure 29:
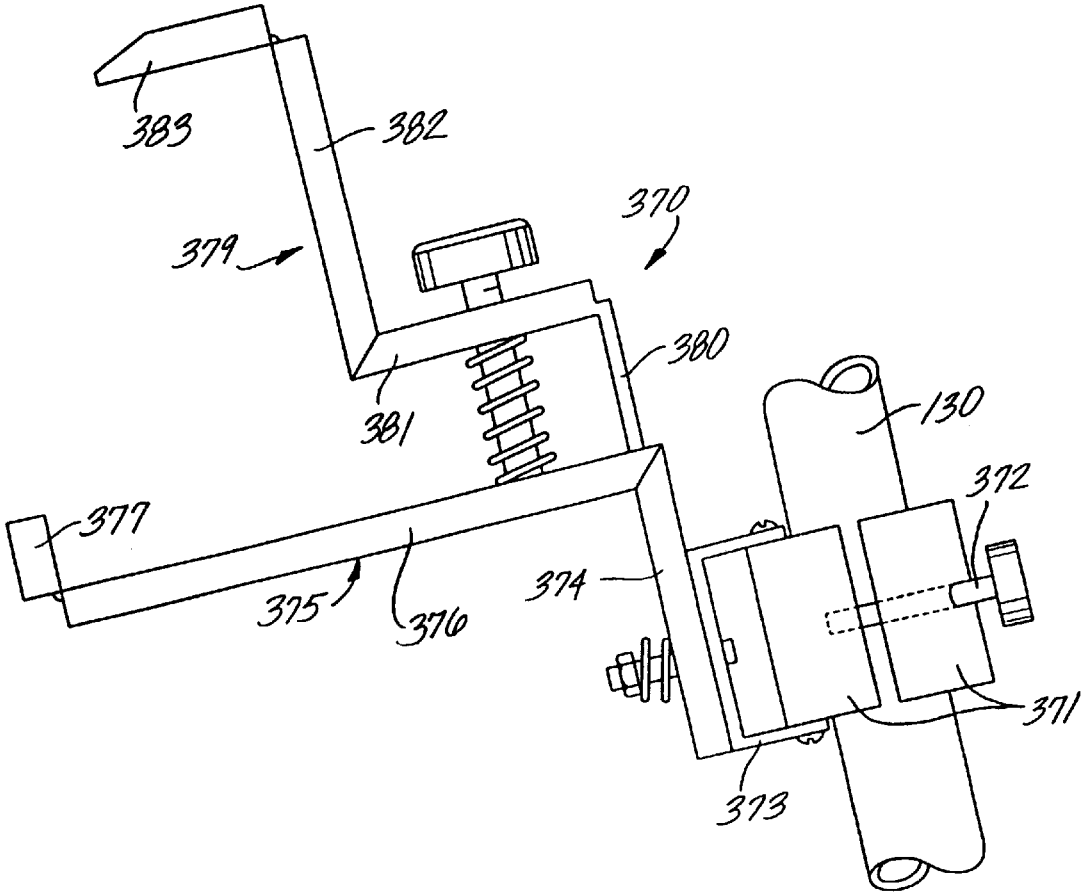
FIG. 29 is a fragmentary elevation view of a multiply adjustable holder useful to hold a carrier of the kind shown in FIG. 7 positionally stable in a transporter of the kind shown in FIG. 7.

A PPS can be rendered positionally stable in the PMS 10, in substantially any relation of the PPS components to each other and in substantially any attitude of the PPS relative to the PMS, by use of clamps or holders engaged between the PPS and one of the leg assemblies of the PMS. A workable clamp arrangement 370 is illustrated in FIG. 29. The clamp arrangement includes an expansible and clampable sleeve 371 which is adjustable about and along a tubular main vertical member 130 of a leg assembly 12 or 16. The sleeve can be provided by semicircular sleeve halves which can be loosened or tightened about member 130 by operation of knob-actuated shaft 372, such as a threaded stud, engaged between them. Sleeve 371 can support a bracket 373 which preferably provides a flat surface disposed parallel to the axis of the sleeve and faces away from the sleeve. The flat face of bracket 373 can be engaged by a flat face on a leg 374 of a first clamp member 375 which has a body 376 which is connected to one end of the leg and which extends preferably perpendicular parallel to leg 374. Body 376 ends in a finger 377 which extends away from and parallel to leg 374. Leg 374 can be spring biased toward bracket 373 by a spring compressed between the head of a bolt and leg 374. The bolt passes from bracket 373 through a hole in leg 374. Clamp member 375 can be rotated about the bolt as desired relative to the bracket.

The clamp arrangement also includes a second clamp member 379. The second clamp member can have a first end leg 380, an end of which is engageable with the surface of the body of the first clamp member in the vicinity of its leg 374. The second clamp member can have a first body section 381 extending normally from the other end of leg 380 for a distance which preferably is about half or less of the length of body 376 of the first clamp member.

A second body section 382 of the second clamp member can extend at right angles from the first body second 381 away from leg 380 to an end thereof from which extends a clamp arm 383. The clamp arm can be perpendicular to body section 382 and parallel to body section 381.

The first and second clamp members are held together by a shaft which extends through a hole in body section 381 of the second member into a tapped hole in the body 376 of the first member near leg 374. The shaft carries a knob 384 which engages the side of first body section 381 which faces away from the first clamp member. A compression spring is engaged about the shaft between the two clamp members. The end of the second member's leg 380 forms a fulcrum against the first clamp member about which the second clamp member can pivot relative to the first clamp member as knob 384 is turned. Such pivoting of the second clamp member relative to the first clamp member moves arm 383 toward and away from finger 377.

Finger 377 can be placed against an inside edge of a tubular element forming the base of the PPS. Arm 383 can engage the top of a cushion associated with the same element. By use of a pair of clamping arrangements 370, each of which can have a wide range of positions on and attitudes relative to a transporter leg assembly, a PPS can be made positionally stable in the transporter in essentially any state and attitude of the PPS.

Another personal transporter 390 according to this invention is illustrated in FIGS. 30 through 35. Transporter 390 incorporates or applies many of the concepts, mechanisms, features and benefits of the transporters described above. Transporter 390 is in the form of a vehicle by which a person requiring assistance, such as a person who normally uses a wheelchair for personal mobility, can more easily, comfortably, safely, and rapidly be moved aboard a passenger aircraft and placed in a passenger seat in the aircraft. The vehicle can be used to remove the person from the seat for movement either within the aircraft or for departure from the aircraft. If desired, the vehicle can be used to receive the person, an airline passenger, from a van or automobile upon arrival at an airport and to move that passenger comfortably, safely and efficiently into and through an airport terminal building and into the aircraft on which the passenger is to fly to a desired destination. Upon reaching that destination the same vehicle, or a different one like or similar to it, can be used to move that passenger from the aircraft, into and through the destination air terminal, and into a van automobile or other form of ground transportation. The transporter is arranged so that it can be moved and operated by only one person. Movement of the passenger into and from the vehicle is accomplished by motor-driven mechanisms in the vehicle, rather than by use of one or more other persons, as presently is common. Presently used procedures for moving such a passenger into and out of an aircraft passenger seat are invasive of the dignity of the person of the passenger, and can result in injury to the passenger and to airline personnel who now must lift and move the passenger, sometimes with unfortunate consequences.

Like the transporters described above, transporter 390 includes a reversible motor-driven winch mechanism 391 which is movably carried in a transverse horizontal beam 392 of variable length mounted in the upper portion of a frame 393 which has supporting wheels 394 and 395. Winch 391 as developed for transporter 390 can be used in the personal transporters described above and may be preferred in those other transporters.

To enable it to be used in airline contexts, transporter 390 necessarily is of limited width, length and height so that it can be rolled onto a commercial aircraft through a conventional passenger door or hatch, and so that the vehicle can be rolled along an aisle between passenger seats, as well as moved as desired to other places in the passenger cabin of the aircraft. The presently preferred passenger transporter has an overall width of 16 inches (40.6 cm.), art overall length of 41 inches (104.1 cm.), an overall height of 73 inches (185.4 cm.), and a wheelbase of 14 inches (35.6 cm.), by 22 inches (55.9 cm.) ± as defined by its four support wheels. The supporting wheels are two coaxial rear wheels 394 and two forward, preferably castered wheels 395 which can swivel about vertical caster axes. Forward 397 and rear 398 portions of the base are elevated above the central floor 399 and are laterally open to provide ports from which can emerge the retractable stabilizer members described below. The transporter frame 393 is mounted to the raised forward and rear portions of the base and, among other things, forms an open yet strong protective enclosure for a passenger seated in the transporter.

Wheels 394 and 395 are mounted to and support a generally horizontal base 400 which has a flat central floor 399 under and forward of a passenger seat area in the transporter. Each of the rear wheels 394 of the transporter preferably is equipped with a known brake mechanism which includes a rocker arm pivoted to the wheel axle and which has a horizontal brake OFF position and an inclined brake ON position relative to the axle. Inclination of that rocker arm in either direction from the brake OFF position is a brake ON position. The forward ends of brake rocker arms are mechanically linked to opposite ends of a transverse lever which is mounted at its center to a brake actuator shaft 401 which extends longitudinally of the transporter to a front end near the front of the transporter. Shaft 401 is rotatably mounted to the underside of base 400 along its center. A transverse pedal lever 402 is mounted to the forward end of shaft 401 under the front margin of the base. Each of the opposite ends of lever 402 serves as a pedal by which a person operating the transporter can operate the rear wheel brakes to set and to release those brakes as needed. The brake operating mechanisms of the transporter preferably includes a detector which senses whether the brakes are ON or OFF.

Figure 31:
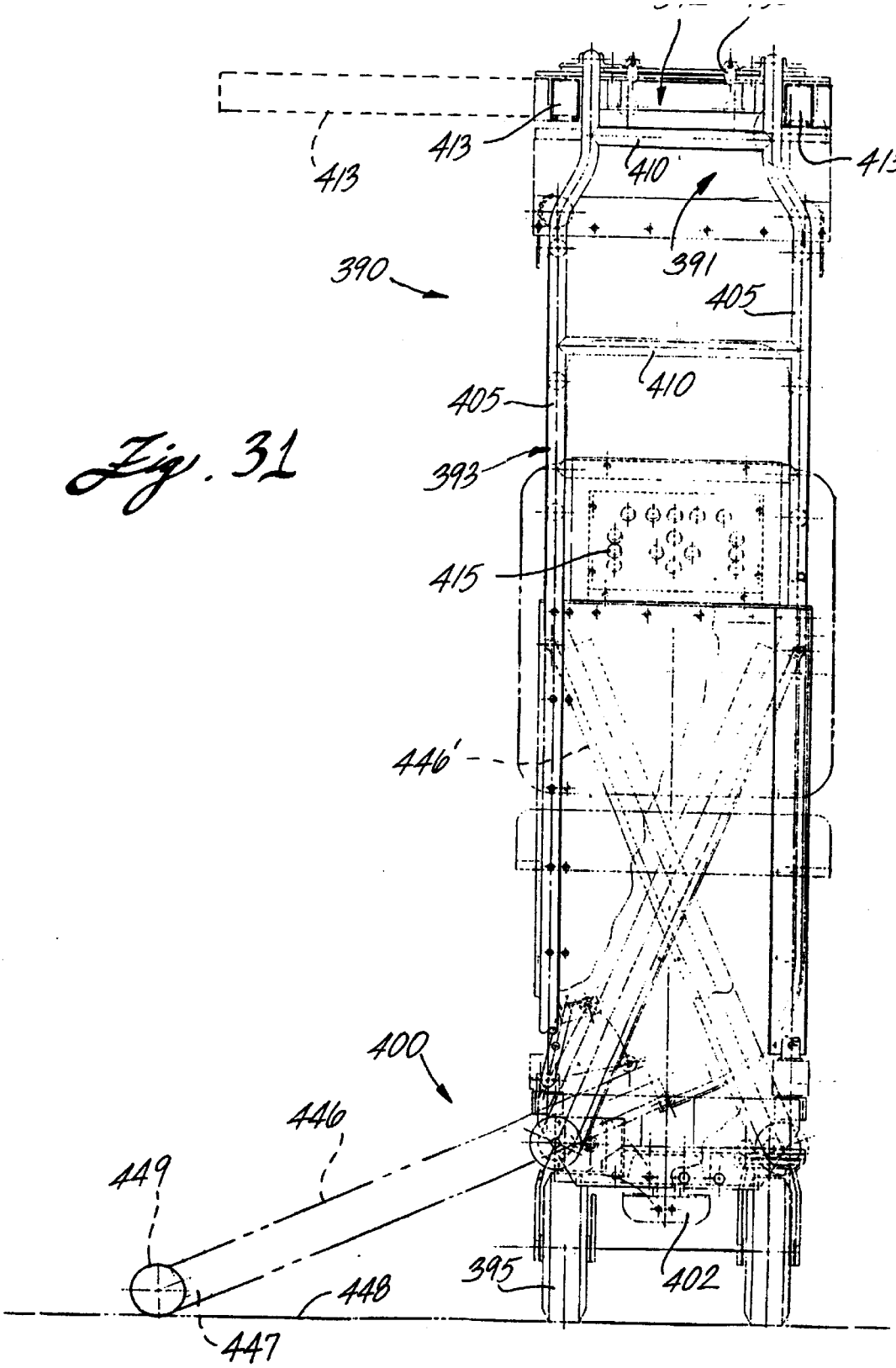
FIG. 31 is a front elevation view of the transporter shown in FIG. 30.
Figure 33:
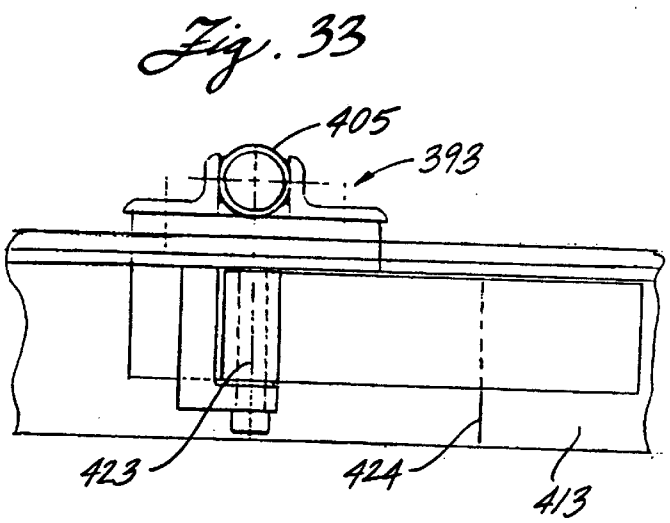
FIG. 33 is a side elevation view of the structure of FIG. 32 in a different state.

Frame 393 of the passenger transporter preferably is fabricated of metal tubing; such tubing is strong, light, and attractive. Thin wall steel tubing is preferred. As illustrated, the frame is of generally cubical configuration, open at the bottom, and has two opposite side structures which are connected by transverse members at suitably spaced locations along the front, rear and top of the frame. Each side structure of the frame preferably is composed of a primary member 405 which is of generally inverted U-configuration having a front vertical leg 406, a rear vertical leg 407, and a horizontal top run. Each side structure preferably also includes front 408 and rear 409 secondary members which are parallel, respectively, to the front and rear legs of the primary member and are spaced inwardly of the frame from the adjacent primary member vertical leg. Each secondary member is connected at its upper end to the horizontal run of the primary member. The lower ends of the primary and secondary members are secured to the side margins of the front and rear raised portions of the transporter base. At suitable places, the secondary members are connected to the adjacent vertical legs of the respective primary members; transverse member 410 connect the side structures FIG. 31 shows that near the top of the frame, the vertical legs of the primary frame members and the secondary members are offset toward each other so that the upper portion of the frame is narrower in width than is the remainder of the frame. That inward offset of each side of the frame at its upper end provides space for stowage of side extensions 413 of a central which-supporting beam 412 of the transporter.

A housing for the transporter stabilizers is located in the frame in the space between the lower portion of each secondary member and the adjacent primary member's vertical leg. There are forward and rear housings. Each housing is carried on a corresponding raised portion of the transporter base, and has closed top, front, rear, and side surfaces. An operator control panel 415 is disposed traversely of the frame above the forward stabilizer housing and faces forwardly, i.e., away from the passenger space within the frame. The lower rear portion of that passenger space is occupied by a forward-facing passenger seat which has seat 416 and rear 417 cushions carried on suitable supports 418 mounted to the base. The volume under the seat bottom can be enclosed and preferably is used as the place for locating one or more electric storage batteries (preferably deep cycle rechargeable storage batteries) for powering the several motors in the transporter.

Figure 30:
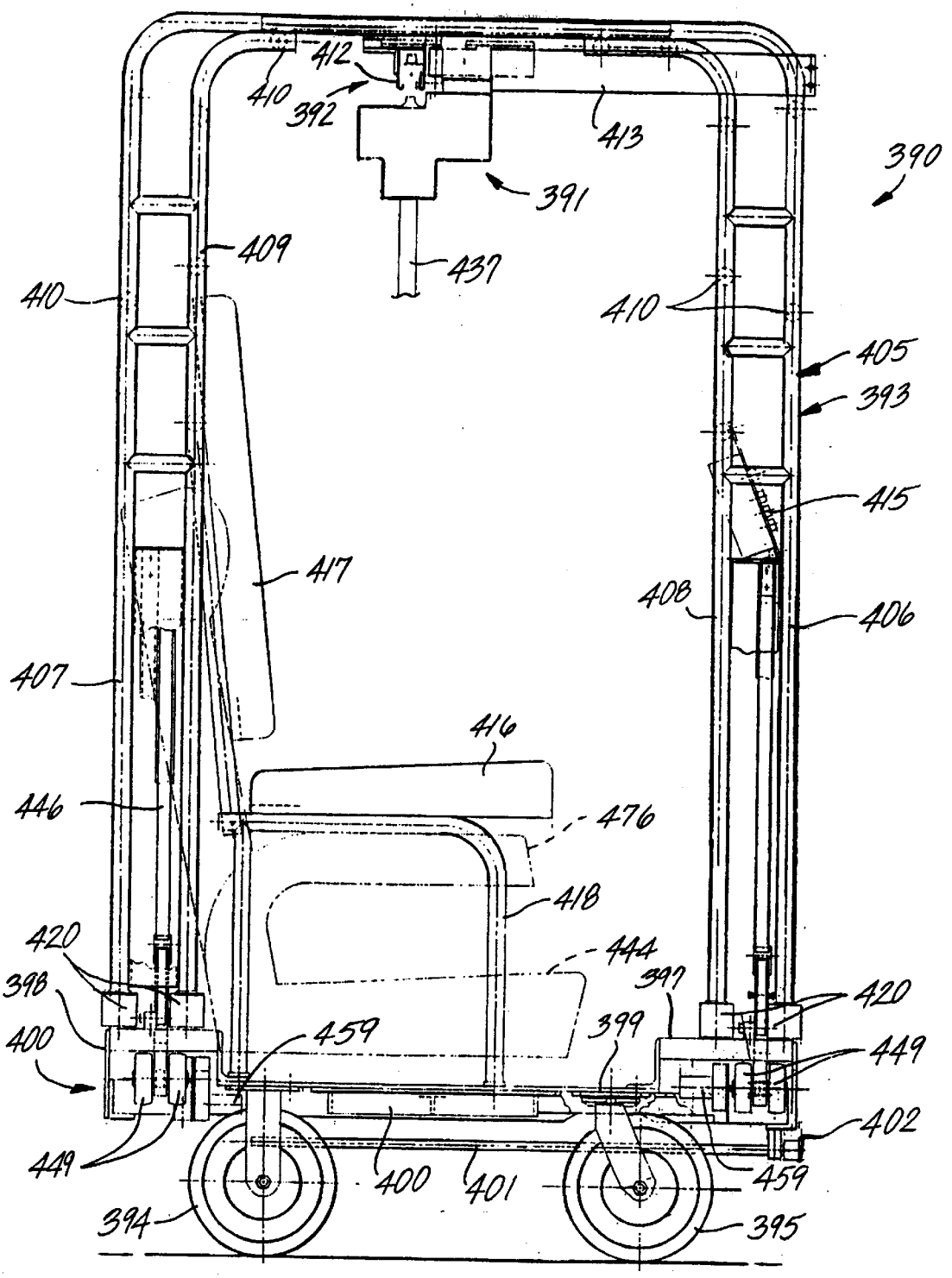
FIG. 30 is a side elevation view of a unitary personal transporter according to this invention which can be used to move a passenger in an aircraft to and from a seat in that aircraft.

A bumper sleeve 420 is rotatably carried about the exterior of each frame vertical member above the adjacent base raised portion; see FIG. 30, e.g. The sleeves are of sufficient height and are located in the transporter at a sufficient elevation that they can make contact with the horizontal bumper rails which typically are provided on the aisle-facing surfaces of the sides of aisle seats in commercial passenger aircraft. The rotatable bumper sleeves contribute to the ease with which the transporter can be moved about the passenger cabin of such an aircraft.

Figure 32:
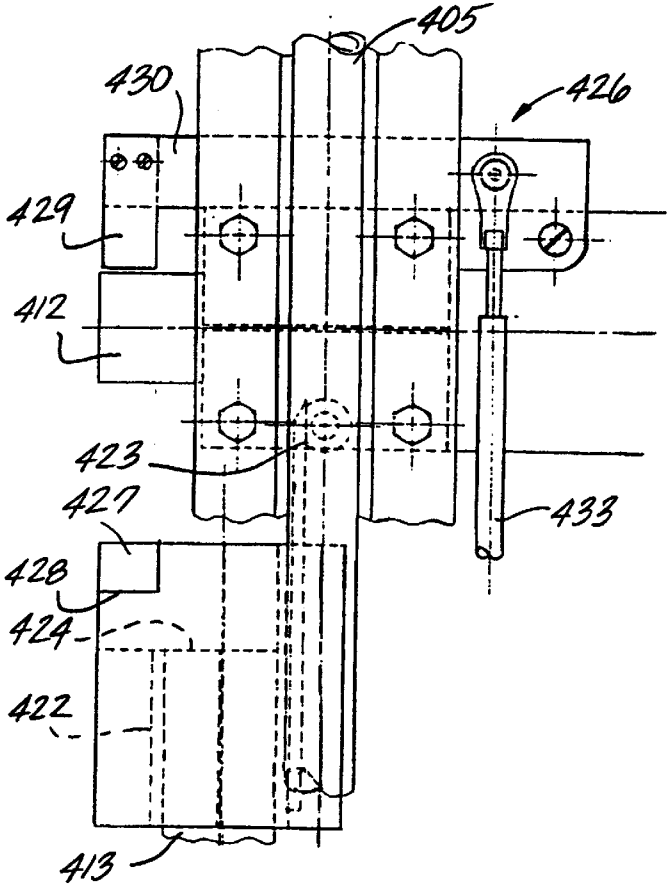
FIG. 32 is a fragmentary top plan view showing a hinge arrangement between base and extension portions of a horizontal beam in the transporter shown in FIG. 30.

A central section 412 of a horizontally extendible beam 400 is disposed transversely of the frame and is carried by and below the frame members which define the top of the frame. The length of that beam section is essentially equal to the width of the transporter. The beam preferably is defined and configured in the manner described above and as shown, for example, in FIGS. 9. Thus, the beam has a generally rectangular cross-section with closed top and side surfaces, and in-and-upturned lips along the side edges of a downwardly opening bottom of the beam. The upper edges of those lips define a pair of spaced rails on which can ride wheels which are components of a carriage for a reversible motor-driven winch mechanism provided for hoisting and lowering a passenger in the transporter. Also, consistent with the preceding descriptions, the beam carries inside it, in electrical isolation from the beam itself (and also from the transporter as a whole), a downwardly facing metal rack. The rack extends along the entire length of the beam. The transverse central beam structure 412 which is fixed in frame 393 is a base section of an overall beam assembly which includes left and right beam extension units 413 which are shown in FIGS. 30–32. Each beam extension has the same cross-sectional geometry and dimensions as the beam base section and carries an electrically isolated, downwardly facing metal rack. Each beam extension is externally reinforced 422 at one end where it is connected to a corresponding part of a hinge 423 which preferably has a vertical axis. The remaining components of each hinge are connected to the exterior of the beam base 412 at a corresponding end of the beam base. Each hinge is structurally rugged and strong as it is required in use to serve as the foundation for a cantilever support of a passenger as the passenger is moved into or out of the transporter. Each hinge is constructed to afford movement of its beam extension 413 about the hinge axis into and out of collinear relation to the beam base section 412, and into and out of a retracted and stowed position within the width of the transporter. Each beam extension, when deployed into collinear relation to the beam base section, has its end 424 in abutment with the adjacent end of the base section; in that relation of an extension to the base section, the extension's conductive rack is conductively coupled to the base section's rack by a resilient contact carried by the extension rack, preferably along its top surface. The stowed position of each beam extension is a horizontal position to the side of the reduced width upper portion of frame 393. See FIG. 31. In its stowed position, each beam extension extends forwardly in the transporter from the adjacent end of the beam base section.

It is important that a beam extension, when moved to its deployed position in the transporter, be kept securely in that position until such time as it is desired to retract and to stow that beam extension. Accordingly, a lockable latch mechanism 426 is associated with the connection of each beam extension to the transporter. As shown in FIG. 32, the structure which moves with the hinged end of a beam extension can define an upstanding lug 427, having a contact latch surface 428, which is moved into a latch position adjacent the rear side of the beam base unit when the beam extension is fully deployed. That lug's contact surface can then be engaged by a finger 429 on a latch arm 430 which is pivoted at its opposite end to the transporter. The latch arm can be locked into its lug retaining position by operating an overcenter toggle actuator 432. That actuator can be located in an upper front portion of the transporter for ready access by an operator of the transporter. The actuator can be coupled to the latch arm near its pivot point by a link rod 433. Thus, when a beam extension is deployed to the side of the transporter, it can be affirmatively locked in that position and held there until affirmatively released from that locked state.

Preferably, the control system for the transporter includes a number of interlock functions, one of which disables operation of a motor-driven winch traverse drive until the correct beam extension has been moved into and locked in its deployed position. A signal for that interlock function can be generated by a limit switch which is mounted in the transporter to be sensitive to movement of a beam extension into its deployed position. Such a limit switch can be mounted to the latch arm near its latch finger so that it engages the beam extension when the finger is in its retaining position with lug 427.

Figure 15:
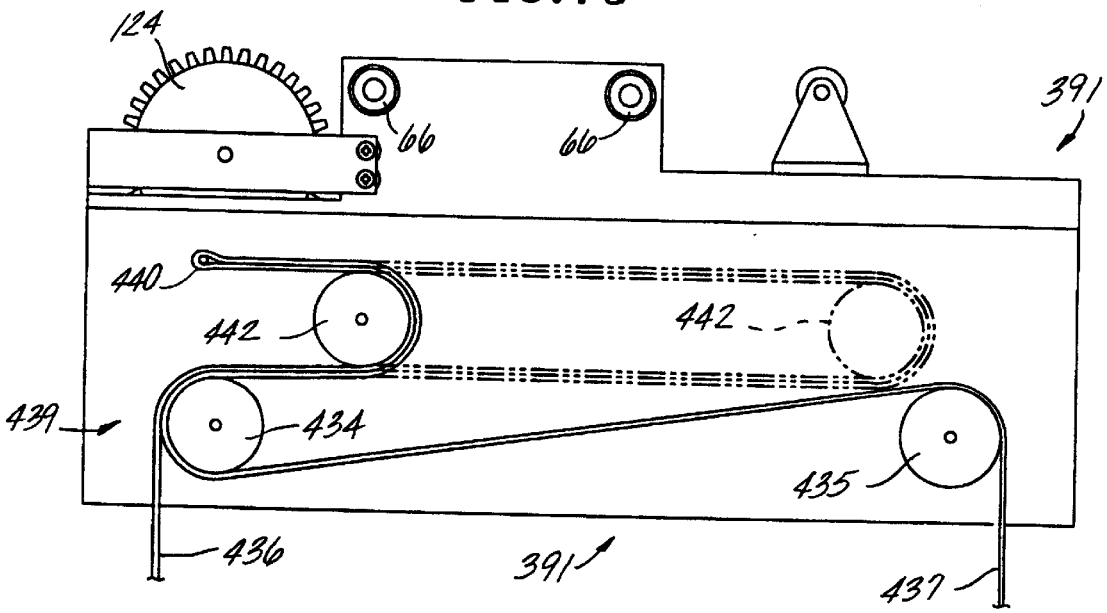
FIG. 15 is a generalized elevation view of a further winch arrangement useful in a transporter according to this invention as engaged with a horizontal support beam, and including a depiction of the way it operates to take in and pay out a pair of flexible load-carrying straps.

A presently preferred fail-safe double lift-point winch mechanism 391 according to this invention is shown in FIGS. 15, 30 and 31. Like the winch 58' described above, it is constructed for taking in a paying out from the winch a pair of flexible load carrying elements; while metal or other cables could be used effectively, the preferred flexible elements are woven nylon straps which are more flexible and easier to handle and manipulate than cables. Winch 391 of transporter 390 includes a pair of rotatable idler rollers or pulleys 434, 435 which are mounted in the lower left and right corners of a winch housing 439. Respective straps 436, 437 engage those pulleys within the housing and pass downwardly out the housing from the left and right sides of the pulleys to the live ends of the straps; see FIG. 15. The winch is arranged internally for varying the lengths of the straps within the housing between the idler pulleys and dead ends of the straps located inside the housing. As shown in FIG. 15, the strap dead ends are located at a selected place along the extent of a single length of strap material where the strap material is folded on itself and engaged with an anchor pin 440 which is fixed in the winch housing near an upper left corner of the housing. The doubled length of strap material to the right of that anchor pin is engaged with the top, right side and bottom of a movable pulley 442. The doubled strap material then extends to the top of and round the left side of the left idler pulley 434. A first section 437 of the strap which is in direct contact with the left idler pulley passes around the bottom of that pulley and then to the top and right side of the right idler pulley 435 and then downwardly out of the housing; a second section 436 of the strap material at the left idler pulley which is atop the first section, and so is not in direct contact with the left idler pulley, passes downwardly from the pulley out of the housing. The live ends of the two strap sections have suitable coupling devices securely connected to them. The couplings can be rings, D-rings, or hooks with or without latches or keepers. The couplings enable the straps to be connected in supporting relation to a carrier for a person whose movement into and out of an aircraft is to be assisted by use of the transporter.

Movable pulley 442 of winch 391 is mounted in the winch housing for horizontal movement across the upper extent of the housing. Such movement is shown in the solid line and phantom line depictions of the movable pulley in FIG. 15. When the movable pulley is in its leftmost position in the housing, the distance along the doubled strap material from the dead end anchor pin to the left idler pulley is least, and the paid out extent of the straps from the housing is greatest. Conversely, when the moveable pulley is at the right end of its range of movement within the winch, the extent of the doubled strap sections in the winch between the dead end anchor and the left idler is greatest, and the vertical extent of the straps outside the winch is least. The mechanical advantage of this arrangement is two, and so one unit of travel of the movable pulley raises or lowers the live ends of the straps two units. The effective range of movement of the movable pulley preferably is about 20 inches (50.8 cm.). The movable pulley preferably translates linearly in the housing. It is controllably driven between the limits of its range of movement by a reversible drive motor. The winch drive motor preferably is mounted to the rear surface of the winch housing and has its shaft parallel to that surface. The motor shaft is coupled via reduction gears to a drive gear secured to the adjacent end of one of a pair of ballscrews which preferably are mounted in horizontal spaced parallel relation in the upper part of the winch housing. That drive gear is meshed with an idler gear which in turn is meshed with a drive gear secured to the adjacent end of the other of the two ballscrews. In that manner, the ballscrews are rotated concurrently at the same rate. The idler gear between the two ballscrew drive gears is accessible through a port in an adjacent end wall of the winch housing. The end face of the idler gear is configured, as by the presence in it of a pair of diametrically aligned holes in the gear, to be engaged by a suitable wrench or crank so that, in the event of a loss of electrical power to the winch motor, the winch can be operated manually to lift or lower a passenger supported by the winch in the transporter.

A ballnut is engaged with each ballscrew. The ballnuts support the opposite ends of an axle on which the movable pulley is mounted. Thus, rotation of the ballscrews produces linear movement of the movable pulley which is carried between them.

The ballscrew drive of the movable pulley, in combination with the reduction of the gearing between the winch drive motor and the ballscrews, provides a fail-safe feature of the winch. If the ballscrews are not rotated, the ballnuts and the movable pulley cannot move along the ballscrews. The pitch of the ballscrews is so high (the helix angle is so low), and the reduction ratio of the input gearing is so high, that the application of force (at a level corresponding to the load capacity of the winch) to the ballnuts in either direction along the ballscrews does not result in rotation of the screws. The ballnuts can move linearly only in response to rotation of the ballscrews. Ballscrews and ballnuts are preferred over conventional lead screws and follower nuts, which could be used, because of their lower fiction.

The winch housing 439 is mounted via its top surface to a winch carrier of the nature described above with reference to FIG. 9. Thus, the carrier is effectively captive to the beam of the transporter but can move along the track defined by the beam, i.e., the beam base unit and its extensions. The winch is drivable along the beam by operation of a reversible motor-driven drive coupled between the winch housing and the rack located inside the beam sections. A winch traverse drive motor is mounted via a gearbox preferably to the front face of the winch housing at one end of the winch. Via reduction gears in the gearbox and additional gears in the winch housing, operation of that motor produces rotation of a large, electrically nonconductive gear 124 which is meshed with the beam rack adjacent one end of the winch carrier. A conductive gear, which otherwise is electrically isolated from the structure of the transporter, is mounted to the winch carrier and is resiliently biased into mesh with the conductive rack; it serves as a moving contact with the rack so that electrical power applied to the rack can be supplied to the motors and other electrical components mounted to the winch housing at any position of the winch along the beam. The conductive contact gear is wire within the winch into the control circuitry for the transporter similarly to the manner depicted in FIG. 8. The relays and most other components of the transporter's control system can be located in a rear portion of the winch housing.

In light of the foregoing description, if will be apparent that the narrow wheelbase of transporter 390 is inadequate to provide stable support for the transporter during movement of a passenger between the transporter and an aisle seat in an aircraft, for example; by use of one or the other of the beam extensions. To prevent the transporter from overturning to the side during such movement of a passenger, it is necessary that the transporter include a mechanism or device which imparts to the transporter an ability to withstand overturning movements applied to it by support of a passenger by the transporter winch at a position of the passenger which is displaced from the longitudinal center plane of the transporter. That objective is achieved in transporter 390 by effectively expanding the width of the transporter wheelbase in the same direction laterally of that center plane by an amount which is adequate to encompass the distance by which the center of gravity of a passenger is moved in the process of moving the passenger between the transporter seat and an aircraft aisle seat next to the transporter. The preferred structures for achieving that effective lateral expansion of the transporter's wheelbase include two pairs of retractable ground-engaging stabilizers 446, one pair for stabilizing the transporter in moving a passenger to and from the left side of the transporter and one pair for stabilizing the transporter in moving a passenger to and from the right side of the transporter. In each pair, one stabilizer is located at the front of the transporter, and the other is located at its rear. When extended from the transporter, the distal ends 447 of the stabilizers engage the floor 448 of the aircraft passenger cabin (or such other substantially flat surface on which the transporter then may be located) at a location which is effective to provide the desired stabilizing action. That location is at least as far from the side of the transporter as the center of gravity of a passenger positioned by the transporter over an aisle passenger seat on that same side of the transporter.

FIG. 30 shows the wheels 449 carried at the lower ends of the two right side stabilizers in transporter 390; in that depiction, the stabilizers are fully retracted into the transporter. FIG. 31 shows the right front stabilizer 446 in both its retracted (solid line) position and its extended or deployed (phantom line) position. That same illustration also shows in phantom lines the position of the left front stabilizer 446' in its retracted position.

As shown best in FIG. 31, each stabilizer 446 is provided as an elongate straight bar or rectangular metal tube. The bar carries a rack 451 along its bottom side over most of the length of the bar. A small guide roller 452 is mounted to he inboard end 453 of the bar adjacent the bottom side of the bar. That guide roller is engaged in a trough-like track 454 which is straight and vertical for the major part of its length but which curves at its lower end toward the position of the lower or distal end of the bar in its retracted position. The track for the right front stabilizer is mounted to the inside of the left wall of the forward stabilizer housing, and its lower end points toward the right lower corner of that housing, i.e., to the opening below the right side of the forward raised portion of the transporter base. The lower end of that guide track 454 is supported in a heavy lower bearing block 456 which has a sloping, generally upwardly open face 457 positioned to approximate an extension of the terminal portion of the track surface with which the guide roller is engaged. That surface lies in a plane which is tangent to a pinion gear 458 with which the stabilizer bar's rack is engaged at all positions of the stabilizer in the transporter. That pinion is driven by a reversible electric motor 459 which is mounted coaxially of the pinion to the rear of the pinion. The upper surface of the stabilizer bar is engaged, in the vicinity of that bar's drive pinion, by a spring-biased follower roller 461 The roller is carried on the end of a follower arm 462, the other end of which is pivotally mounted to the stabilizer housing above an upper bearing block 463 positioned just above the retracted position of the stabilizer bar's distal end wheels. The spring-loaded follower acts to keep the bar's guide roller 452 engaged in track 454.

FIG. 31 shows that the geometry of the track 454 is defined in combination with the length of the stabilizer bar so that rotation of pinion gear 458 moves the stabilizer bar past it while the cooperation of the bar's guide roller with the track contour determines the instantaneous attitude of the stabilizer relative to the transporter. As the pinion pulls the stabilizer downwardly past it, the distal end of the stabilizer moves out and down from the transporter. As the upper end of the stabilizer nears the lower bearing block 456, the wheels 449 at the distal end of the stabilizer engage the floor 448 of the aircraft passenger cabin (or such other surface on which the transporter is located) and support the stabilizer in its last increments of movement out of the transporter. As the stabilizer reaches the end of its outward travel, the stabilizer rotates slightly in a clockwise direction about its inner end. That rotation causes the upper end portion of the stabilizer bottom surface, in the area which does not include the rack, to bear upon surface 457 of the lower bearing block 456. At the same time, the upper surface of the stabilizer contacts a flat surface 464 of the upper bearing block 463 at a location on the stabilizer more toward the distal end. At that point, the stabilizer no longer can rotate clockwise relative to the transporter; that is, the distal end of the stabilizer cannot rise relative to the transporter. As a result, the stabilizer resists overturning of the transporter to the side from which the stabilizer has been extended.

A pair of sensors preferably are associated with each stabilizer; one sensor 466 (see FIG. 35) detects the arrival of the upper end of the stabilizer at its fully retracted position in the stabilizer housing, and the other sensor 467 (FIG. 34) detects the arrival of the upper end of the stabilizer at the position which corresponds to fully deployed extension of the stabilizer from the transporter. Those sensors preferably are limit switches which, upon closure, generate signals which are used to control operation of the transporter.

Figure 34:
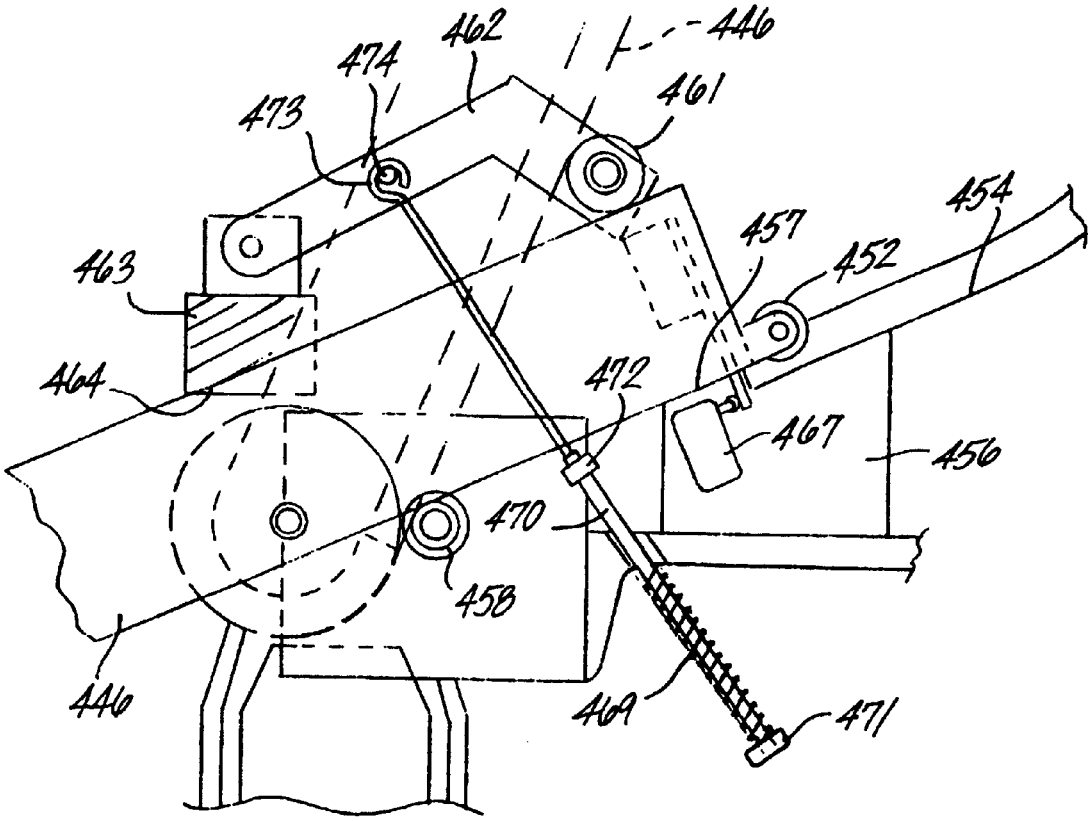
FIG. 34 is an enlarged fragmentary elevation view of the inner end of an extended stabilizer outrigger and shows the spring-loaded follower arm which operates to assure that the outrigger moves along a desired path.
Figure 35:
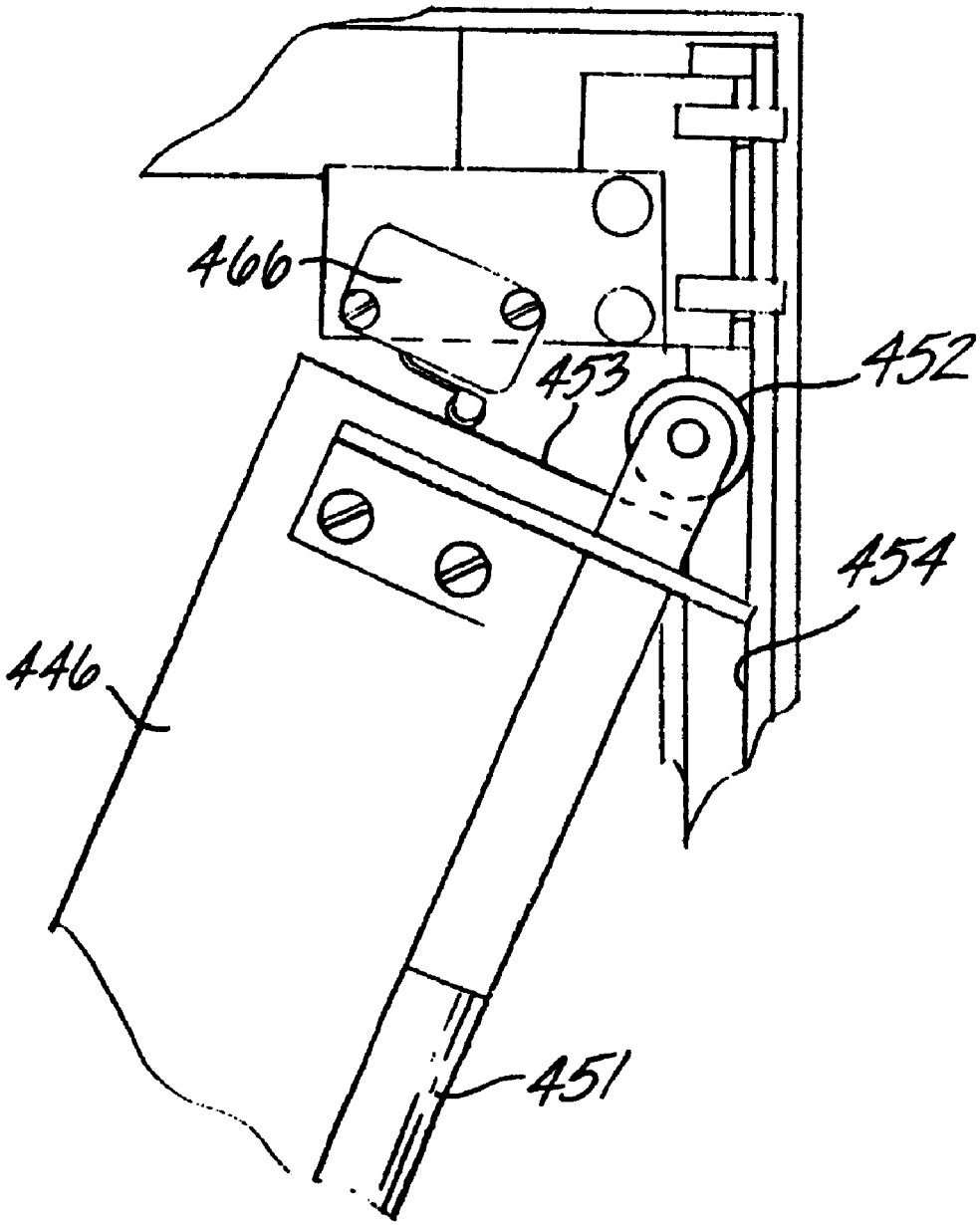
FIG. 35 is an enlarged fragmentary elevation view of the upper end of the retracted outrigger.

The spring loading of each stabilizer follower arm 462 is produced by coupling a spring 469 between the arm near its location of pivotal support and the base of the transporter. As shown in FIG. 34, the spring can be a compression spring located below the element of the base to which the lower bearing block 456 is mounted. The upper end of the spring can engage the underside of that element around a hole in the element. A rod 470 can extend downwardly through that hole and through the compression spring 469 to a plate 471 which makes contact with the lower end of the compression spring. The upper end of the rod can connect to the center of a bar or yoke 472 near the bottom of the pertinent stabilizer bar. A pair of elongate hooks 473 can be connected between the ends of the yoke 472 and pins 474 mounted to the opposite sides of the follower arm. The spring is compressed at all times, and so the follower arm is pulled into forcible contact of its follower roller with the upper surface of the stabilizer as the stabilizer is moved in and out of the transporter by drive pinion 458. That action of the follower arm and roller on the stabilizer causes the stabilizer guide roller to maintain contact with its guide track throughout movement of the stabilizer by its drive pinion.

All of the stabilizers in the transporter are arranged. driven and biased in the manner described above. The left stabilizers and their mountings and drives are mirror images of the right stabilizers described above. One left stabilizer and one right stabilizer are located in each of the stabilizer housings. The left stabilizers are located behind the right stabilizers in the respective stabilizer housings.

The position detecting sensors associated with each stabilizer preferably are used in conjunction with the beam extension position sensors to enable and disable operation of the winch hoist and traverse motors. For example, the right stabilizer deployment sensors can be connected in series with each other and with the right beam extension position detecting sensor in such a way that the hoist drive motor in the winch cannot be operated, nor can the winch traverse motor be operated to move the winch to the right from its home position along the beam, until all three of those position detecting sensors have been operated to signal that both right stabilizers are fully deployed and that the right beam extension is deployed and latched in place. Operation of the stabilizer position detecting sensors 466 at the upper ends of the stabilizer guide tracks can be used to signal to an operator of the transporter that the stabilizers are fully retracted, and the transporter is ready to be moved along a passenger aisle in an aircraft, e.g.

The distance between the stabilizers for each side of the transporter is adequate that, when the transporter is positioned next to an aisle seat 444 in an aircraft with its own seat directly adjacent to the aisle seat, the rear stabilizer on that side of the transporter can be deployed behind the foundation for that aisle seat, and the forward stabilizer can be deployed behind the foundation of the next-forward aisle seat. See FIG. 30. As shown in FIG. 30, the top of the bottom seat cushion 416 in transporter 390 is located at an elevation in the transporter which is just above the top of the aisle-side armrest 476 for the aircraft passenger seat. To move a passenger from the transporter to that aisle seat, the passenger is lifted in the transporter only that amount needed to cause the passenger, and the passenger carrier located between the passenger and the transporter seat, to be raised clear of the transporter seat. The passenger then can be moved laterally out of the transporter frame to a position above the aisle seat, and then lowered into the aisle seat. When the passenger has been placed in the aisle seat by the transporter, the carrier is located between the passenger and that seat.

Figure 36:
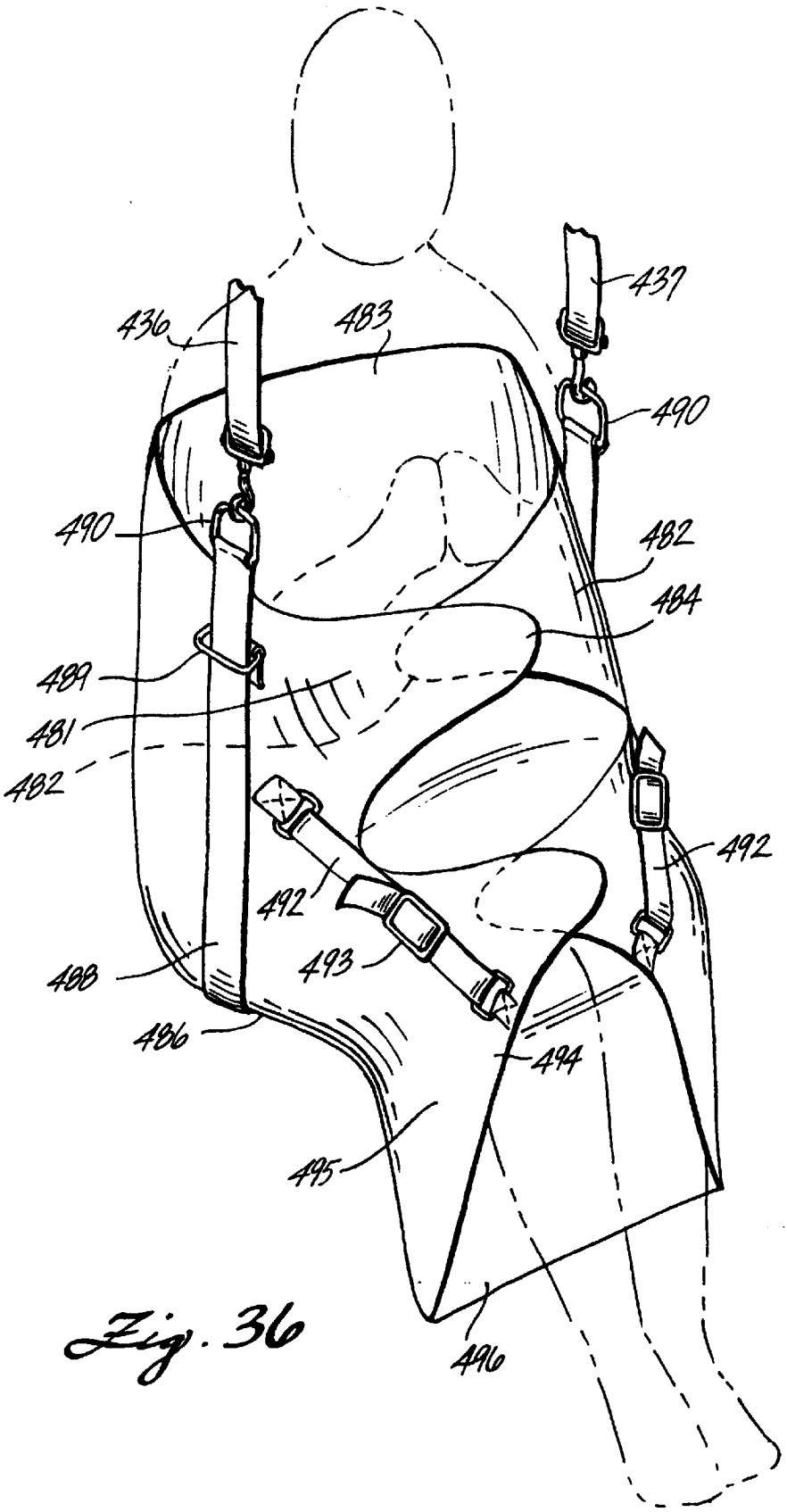
FIG. 36 is a perspective view of a personal carrier useful with the transporter shown in FIG. 30.

A presently preferred carrier 480 for a passenger is shown in FIG. 36. The carrier preferably is constructed of heavy canvas or other strong fabric. It is shaped to extend along the back of a passenger, as well as along the buttocks, thighs and lower legs of a passenger seated in it. The carrier includes side flaps 481, 482 which are arranged to extend, in the manner of a shawl, from the back area 483 around the sides and across the front of a passenger where the ends 484, 485 of the flaps can overlap each other as shown in FIG. 36. The overlappable ends of the flaps can be secured together in a wide range of relations by Velcro fastener elements which are affixed to the flaps in suitable ways, as by being sewed to the carrier fabric. The rear 483 and seat (buttocks and thigh) 486 portions of the carrier preferably include pockets into which are placed, preferably removably, semirigid panels, such as pieces of thick polyethylene or polypropylene sheet, to impart desired stiffness to the carrier in those areas for the comfort of the passenger.

The carrier can include a length of wide strap material which extends transversely under the carrier seat area and upwardly from the seat on each of its sides to a height corresponding to about the waist of an adult passenger in the carrier; the wide strap provides a reinforced zone in the carrier for support of a passenger over a relatively wide area in the bottom of the carrier. A plurality of spaced coupling moieties can be secured to the ends of that wide strap at horizontally spaced locations. A respective one of two relatively narrow support straps can be coupled by a corresponding coupling moiety to a selected one of the cooperating coupling moieties in the vicinity of the passenger's waist. The selection is made on the basis of the location of the passenger's center of mass relative to the back portion of the carrier; preferably, a selection is made which causes the connection to be in line with or forward of the center of mass. Each support strap extends from its lower end connection through a stabilizing guide loop on the side of the adjacent flap which is away from the passenger to its upper end where it is engageable by the coupling carried at the live end of the winch strap on that side of the passenger.

Alternatively, as shown in FIG. 36, a single longer wide support strap 488 can pass at its center under the seat portion of the carrier and upwardly on each side, of the carrier through a guide loop 489 secured to the outside of each flap 481, 482 to an upper end which carries a ring 490 or the like by which the carrier support strap ends can be connected to winch straps 436 and 437.

The carrier 480 can also include a knee and lower leg support strap 492 on each side of the carrier. That strap can include a length adjusting device 493 at or between its ends. An upper end of that strap is connectable, via suitable connection moieties, to a carrier flap 481, 482 on the flap side away from the passenger near the passenger's shoulder. The other end of that strap is connected (or is connectible) to the corner of a piece 495 of carrier material which is near the passenger's knee; that piece of material preferably is triangular in shape and has its edge opposite from the knee corner connected along the edge of the portion 496 of the carrier which is located behind the lower legs of the passenger. A load carrying cord can be included in the hem of that triangular piece of material which extends from the knee corner to the bottom of the piece 495.

A preferred manner of use of the carrier described above is that the passenger arrives at the departure airport seated in the front passenger seat of an automobile or van, e.g., with the carrier 480 placed between the passenger and the vehicle seat. The passenger is moved directly from the vehicle to transporter 390. The transporter is placed alongside the seated passenger after the vehicle door by the passenger has been opened. The transporter's outrigger stabilizers are deployed under the vehicle and the corresponding beam extension is deployed to extend into the vehicle over the passenger. The transporter's winch straps 436, 437 are lowered appropriately. The carrier side flaps are closed loosely about the passenger whose arms may be inside or outside the closed flaps, as desired. The winch strap-end couplings are connected to the upper Solids of the carrier's vertical support straps 488. The length of the carrier's shoulder-knee straps 492 can be adjusted so they are not slack. The transporter winch then can be operated to lift the passenger from the vehicle seat. The winch traverse drive then can be operated to move the passenger, in the carrier 480, laterally into the transporter where the passenger can be lowered directly onto the transporter seat. The lower portion of the carrier can support the passenger's lower legs in the manner shown in FIG. 36. During such movement, the passenger is in a normal seated position in a carrier which has sufficient rigidity under and behind the passenger that the passenger is comfortable. No other person is required to meaningfully touch the passenger or to bear any portion of the passenger s weight as the passenger is transferred from the vehicle into the transporter.

The carrier side flaps can be closed about the passenger, if desired, only during transferring movement of the passenger into and out of the transporter. The benefit of the flaps is that they provide control over the position of the passenger (i.e., the location of the passenger's center of mass) in the carrier during transfer processes for the safety and comfort of the passenger. When the passenger is seated in the transporter on the carrier, the side flaps can be opened and tucked behind the passenger between the carrier back and the transporter seat back. Alternatively, the carrier flaps can be connected at their overlappable ends to the front part of the transporter frame to provide a partial enclosure for the passenger within the transporter if that should be desired for any reason.

It will be apparent that when the passenger has been placed in an aircraft aisle seat by use of the carrier and the transporter, the carrier is interposed between the passenger and that seat. The carrier does not restrict the movements of the passenger in that seat, but is readily available for use when it is desired or needed to transfer the passenger from the aircraft seat. The transporter used to initially place the passenger in the aircraft seat can remain aboard the aircraft during flight; in that event, the transporter is useful to move the passenger from the aisle seat to a lavatory, e.g., and back. On the other hand, if the transporter used to load the passenger into the aircraft does not remain aboard during flight, a transporter based at the destination airport can be used to move the passenger from the aircraft. through that airport, and into ground transportation.

It will be appreciated that the airline passenger carrier 480 shown in FIG. 36 and described above can be used to advantage in the other transporters shown and described, as well as in combination with patient lift and hoist systems heretofore known. The advantage of the present carrier is that it supports the person using it safely comfortably and stably in a conventional seated position, rather than some other position which often is so confined and restricted that bones may be broken. The carrier can be used with single point lifts and hoists by use of a strongback or spreader such as is shown in FIG. 1.

The location of winch 391 in transporter 390 is defined to be above the center of the anticipated front-to-back range of locations of the centers of mass of a range of passenger seated in the transporter. If desired, however, the winch housing can be mounted to the transporter frame for limited movement along the top of the frame.

The presently preferred arrangement of the transporter's control panel is shown in FIG. 31. The control panel has in its center four push button switches arranged in a diamond pattern; the upper and lower buttons in that pattern operate switches which initiate raising and lowering operation of the winch mechanism, while the left and right buttons in that pattern initiate left and right movement of the winch mechanism along the beam. Those operations continue so long as the button is depressed unless the operation is disabled by an interlock feature of the transporter control system or a winch or traverse movement limit switch has been operated.

There are three buttons in a vertical array on each side of the winch and traverse drive switch buttons. The left array pertains to the left stabilizers and the right array pertains to the right stabilizers. In each array, the upper button is illuminated red when the outriggers are fully deployed and the right beam extension has been retracted; it signals the transporter operator to retract the right beam extension and to initiate retraction of the right stabilizers. The central button in the array may be green and depressing that button controls operation of the stabilizer drive motors to deploy (extend) the right outriggers. The lower button in the array may be red and it controls retraction of the right stabilizers. The center and lower buttons are disabled from having an effect if the right beam extension is not in its deployed and latched state.

Also, the transporter control panel includes a horizontal row of five stations in the upper central area of the panel. The left station can be a fuse holder. The station to the right of the fuse holder can be an alarm button, depression of which rings a bell or operates a beeper. The alarm is useful when the transporter is being moved within an airline terminal, e.g. The center station can be a green indicator light to signal that the brakes of the transporter wheels are OFF and that power is available to operate the transporter. The station next to the right can be a red indicator light to signal that the brake mechanism is engaged and that power is available. The right station in the row can be a reset button for a circuit breaker.

Variations from the structures and procedures described above and illustrated in the accompanying drawings may be practiced without departing from the scope of this invention. For example, in a winch the dead end of one or more lift cables or straps can be mounted directly to the ballnuts. rather than affixed to the winch housing, so that movement of the ballnuts alters the length of the cables or straps between their dead ends and the location at which the cables or straps exit from the housing. If cables rather than straps are used as the winch flexible load carrying elements, multi-sheave movable pulleys can be used in combination with a fixed axle multi-sheave pulley to provide any winch mechanical advantage which may be desired. If desired, the path of movement of the movable pulley can be vertical, rather than horizontal; a vertically oriented movable pulley drive can be located at an end of the winch housing, such as the end of the housing which is adjacent to the fixed leg of transporter 10. A transporter can be equipped with motor driven support wheels.

Also, other arrangements for supporting the winch from the transporter load beam, or other ways for supplying electrical power from a power source on the transporter frame to the movable winch housing, or other ways for providing a load beam which is effectively variable in length (such as a telescoping beam arrangement), or other forms of carriers or slings for supporting a person from the transporter load beam may be practiced within the scope of this invention.

What is claimed is:

1. Apparatus for transporting a person comprising a frame movable on supporting ground engaging wheels connected to the frame, a unitary reversible motor-driven winch mechanism moveable under load along a track supported in an upper location in the frame, the winch mechanism being operable to take in and pay out in synchronism at spaced locations in the winch a pair of flexible load carrying elements, couplings carried by the load carrying elements by which the elements can be releasably connected in load supporting relation to spaced locations on a carrier for supporting a person, the track having a substantially horizontal base section and an extension portion mounted for movement between an operative position in which the extension is aligned with the track base section and a stowed position in the apparatus in which the track extension is substantially perpendicular to the track base section, the winch mechanism being movable along and between the base section and the aligned extension.

2. Apparatus according to claim 1 in which the track extension portion has a stowed position substantially within the width of the frame.

3. Apparatus according to claim 2 in which the track extension portion moves about a vertical axis in movement between its operative and stowed positions.

4. Apparatus according to claim 3 in which the track extension portion, in its operative position, extends outwardly from a side of the frame, and including an outrigger leg movable between a stowed position within the frame and a deployed position in which the leg extends outwardly from said side of the frame into contact at a location spaced from the frame with a support surface on which the frame is supported by its wheels.

5. Apparatus according to claim 4 including a sensor associated with the outrigger leg for disabling operation of the winch when the outrigger leg is not in its deployed position.

6. Apparatus according to claim 5 including a sensor associated with the track extension for the same side of the frame as that side from which the outrigger leg can be extended and connected in series with the outrigger leg sensor.

7. Apparatus according to claim 1 in which the frame has a width between opposite sides of the frame which is less than the width of a minimum width aisle between passenger seats in a passenger aircraft.

8. Apparatus according to claim 7 in which the seat faces in a direction parallel to the sides of the frame, and the seat elevation in the apparatus is related to the height of an aisle armrest of a passenger seat in a passenger aircraft.

9. Apparatus according to claim 7 including a carrier configured for supporting a person in a seated position when connected to said couplings.

10. Apparatus according to claim 9 in which the carrier has relatively stiff seat and back portions.

11. Apparatus according to claim 1 including a seat within the frame on which a person in a carrier can be supported.

12. Apparatus for transporting a person comprising a frame movable on supporting wheels connected to the frame, the frame including a pair of generally parallel and generally vertical leg assemblies to which the wheels are connected at lower ends of the leg assemblies and a horizontal beam to which upper ends of the leg assemblies are connected, and a reversible motor driven winch mechanism coupled to the beam for movement along the beam, the winch mechanism being operable to take in and pay out plural flexible load carrying elements, the beam comprising a fixed-length base section and an extension coupled to one end of the beam base section for movement between a collinear relation to the base section and a substantially vertical relation to the base section.

13. Apparatus according to claim 12 in which one of the leg assemblies is movable under load along the beam when the extension is in its collinear relation to the beam base section, and the winch mechanism is movable along the collinearly related extension to and from the base section.

14. Apparatus according to claim 13 including a latch releasably engageable between the beam and the movable leg assembly.

15. Apparatus according to claim 13 in which the movable leg assembly is disconnectible from the beam.

16. Apparatus according to claim 15 including a coupling moiety at the end of the beam extension opposite from the beam base section and engageable with a substantially stationary cooperating coupling moiety for support of the deployed beam extension unit.

17. Apparatus according to claim 12 in which one of the leg assemblies is movable along the beam relative to the other leg assembly to a state of maximum frame width in which the distance between the leg assemblies along the beam is adequate to transversely span a bed and a chair space next to the bed.

18. Apparatus according to claim 17 in which the frame has a state of minimum width in which the apparatus width is adequately small to pass through a doorway in a residential structure.

19. Apparatus for transporting a person comprising a frame movable on supporting wheels connected to the frame, a reversible motor driven winch mechanism supported in the frame in an upper location in the frame, the winch mechanism being operable to take in and pay out at least one flexible load carrying element, the frame including a pair of generally parallel and generally vertical leg assemblies to which the wheels are connected, a horizontal beam to which upper ends of the leg assemblies are connected and to which the winch mechanism is coupled for movement along the beam, the leg assemblies defining respective sides of the frame and extending between ends of the frame, and including braces detachably connectible between lower portions of the leg assemblies across a central space in the frame between the leg assemblies.

20. Apparatus for transporting a person comprising a frame movable on supporting wheels connected to the frame, a reversible motor driven winch mechansim supported in the frame in an upper location in the frame, the winch mechanism being operable to take in and pay out at least one flexible load carrying element, the frame including a pair of generally parallel and generally vertical leg assemblies to which the wheels are connected, and a horizontal beam to which upper ends of the leg assemblies are connected and to which the winch mechanism is coupled for movement along the beam, the beam being comprised of a horizontal base unit and an extension unit connected to one end of the base unit for movement between a deployed collinear abutting relation to the base unit and a stored position in which the extension hangs from one end of the base unit, one of the leg assemblies being fixed to the other end of the base unit, and the other leg assembly being selectively movable under load along the deployed extension between states of maximum and minimum width of the frame in a direction along the beam.

21. Apparatus according to claim 20 in which the winch mechanism is movable along the beam base unit and the deployed extension unit.

22. Apparatus according to claim 21 including a reversible motorized winch traverse drive coupled between the beam and the winch mechanism.

23. Apparatus according to claim 22 in which power for operation of the winch mechanism and the winch traverse drive is supplied via the beam.

24. Apparatus according to claim 23 in which the beam includes an electrically isolated conductive member extending substantially along the length of the beam, and a conductive contact element is carried by the winch mechanism in conductive contact with the conductive member.

25. Apparatus according to claim 24 in which the conductive member comprises a rack, and the winch traverse drive includes a nonconductive gear engaged with the rack and carried by the winch mechanism.

26. Apparatus for transporting a person comprising a frame movable on supporting wheels connected to the frame, a reversible motor driven winch mechanism supported in the frame in an upper location in the frame, the winch mechanism being operable to take in and pay out in synchronism at spaced locations in the winch a pair of flexible load carrying elements, the frame including a pair of generally parallel and generally vertical leg assemblies to which the wheels are connected, and a horizontal beam to which upper ends of the leg assemblies are connected and to which the winch mechanism is coupled for movement along the beam, the winch mechanism including a fixed axis idler pulley for each flexible element over which the respective flexible load carrying element extends and from which it passes from the winch, the flexible elements each having a dead end fixed in the winch, and a linearly movable pulley operably associated with the pair of flexible elements between their dead ends and their idler pulleys.

27. Apparatus according to claim 26 including a motor driven screw to which the movable pulley is coupled for linear movement in response to rotation of the screw.

28. Apparatus according to claim 27 including a pair of ball screws in parallel relation to each other and a ball nut engaged with each ball screw, and in which the movable pulley is positioned between the ball screws on an axle carried by the ball nuts.

29. A carrier by which a person can be moved by a hoist to and from a position of supine support of the person on a bed, the hoist affording a pair of transversely spaced and syncronously raisable and lowerable lifting couplings, the carrier comprising a seat portion and a torso portion connected for movement of the seat and torso portions between a substantially coplannar relation and a chair relation between them, lift points on each side of the carrier at the connection between the seat and torso portions and at locations on the seat portion and the torso portion spaced from said connection, and a pair of lifting harnesses engageable between respective ones of the lifting couplings and the lift points on each side of the carrier, each harness being adjustable for varying the effective distance in the harness from a location of engagement of the harness with a coupling to respective locations of the harness with the carrier side lift points, each harness comprising a hub assembly connectible to a lifting coupling and three straps extending from the hub assembly to ends defining the respective locations of engagement of the harness with the carrier side lift points, the hub assembly including means for varying the effective lengths from the hub assembly of at least one of the three straps.

30. Apparatus according to claim 29 in which the harness is engageable with the carrier when the carrier is separately supported and horizontally disposed with its seat and torso portions in coplanar relation, and in which the harness is arranged to move the carrier portions into their chair relation in response to lifting of the carrier by the hoist couplings.

31. Apparatus for transporting a person comprising a variable-length beam, a pair of leg assemblies movable on ground-engaging wheels for supporting the beam horizontally at a selected elevation, a motor-driven winch supported by the beam and movable under load along the beam between the leg assemblies, one of the leg assemblies being selectively movable separately from a change in the beam length along the beam toward and away from the other leg assembly during load-supporting engagement of the one leg assembly with the beam.

32. A carrier for supporting a person in a hoist comprising a fabric construction having back and seat portions disposable behind the back and under the buttocks and thighs of a seated person, a reinforced zone of the construction extending under the seat portion and upwardly from opposite sides of the seat portion to a height above the seat portion to about the waist of a person supported by the seat portion, the construction including a pair of side flaps extendible from respective side edges of the back portion around the sides and across the front of a person supported by the seat portion to end margins at which the flaps can be connected together to at least partially enclose the torso of the person, and a support strap associated with each side flap, each support strap being connectible with the corresponding end of the reinforced zone and passing through a guide on the side of the corresponding flap to an upper end which carries a device by which the strap can be connected to the hoist and by which a person in the carrier can be raised and lowered by operation of the hoist.

33. A carrier according to claim 32 in which the fabric construction includes a lower leg portion connected to a front edge of the seat portion and which is disposable behind the lower legs of a person supported on the seat portion, and means connected to the lower leg portion for holding the lower leg portion forwardly from a state in which it hangs from the front edge of the seat portion.

34. A carrier according to claim 33 in which said means for holding includes a fabric panel extending from each side edge of the lower leg portion to a location proximate the top of the knee of a person supported by the seat portion, and a stay strap connectible from said location to a point on the adjacent flap near the shoulder of the person.

35. A carrier according to claim 32 including stiffener material of selected rigidity in the seat and back portions of the construction.

36. A carrier according to claim 35 in which the stiffener material is removable from the construction.

37. A winch for lifting and lowering a person positioned in a carrier such as a sling or a seat, the winch comprising a housing from which can extend at horizontally spaced locations of the housing respective ones of a pair of elongate flexible load carrying elements having live ends movable toward and away from the housing in response to operation of the winch, the flexible load carrying elements having dead ends in the housing, a pair of spaced fixed-axis idler pulleys mounted respectively to the housing at said locations and with which corresponding ones of the elements are engageable, a movable pulley with which both elements are operatively engaged between their dead ends and the respective idler pulleys, and linearly-acting motor-powered drive means coupled to the movable pulley operable to move the movable pulley for varying the lengths of the flexible elements between their dead ends and the respective idler pulleys.

38. A winch according to claim 37 in which the drive means includes a ballscrew and a ballnut to which the movable pulley is coupled.

39. A winch according to claim 37 in which the flexible elements are straps which are disposed in layered relation to each other between their dead ends and partially around the movable pulley.

40. A method for moving a person from a bed through a doorway comprising the steps of locating under the person as supported on the bed a liftable carrier for the person, locating above the person a winch mechanism movable along a track carried by a pair of wheeled support legs disposed adjacent opposite sides of the bed, operating the winch to raise the carrier and the person to a position above the bed, moving the legs relative to the bed to a position in which the bed is out of the space between the legs, moving the winch with the carrier and the person supported thereby along the track toward one of the legs, moving the legs relatively toward each other along the track into predetermined relation of the legs, in which the person is supported between the legs and the legs are sufficiently close to each other to pass as a unit through a doorway, effectively reducing the length of the track to a length corresponding to the predetermined relation between the legs, and moving the combination of the legs, track and person through the doorway.

41. The method of claim 40 in which the carrier is a component of the bed.

42. The method of claim 40 including lowering the person via the winch and the carrier onto a seat supported by and between the legs after moving the legs into the predetermined relation of the legs.

43. The method according to claim 40 including guiding one of the legs from and along a side of the bed during movement of the legs to the position in which the bed is out of the space between the legs.

44. A method for moving a person to a seat in a passenger aircraft including the steps of:

at a location outside the aircraft, seating the person on a seat in a wheeled vehicle with a carrier for the person interposed between the person and the vehicle seat,s moving the vehicle with the person seated therein into the aircraft to a position adjacent an aircraft seat into which the person is to be placed, coupling the carrier to a winch in the vehicle, operating the winch to raise the carrier with the person therein from the vehicle seat, locating a track carried by the vehicle over said aircraft seat, moving the winch along the track, with the person supported in the raised carrier by the winch, to a position of the carrier over the aircraft seat thereby to move the person from a position within the vehicle to the position over the aircraft seat, operating the winch to lower the carrier and the person to support thereof by the aircraft seat, and uncoupling the carrier from the winch.

45. The method according to claim 44 in which the vehicle has a width which enables the vehicle to be moved along an aisle in a passenger cabin of the aircraft, and in which the step of locating the track includes extending the track laterally from the vehicle to a location over the aircraft seat.

46. The method according to claim 45 including the further step of effectively expanding the wheelbase of the vehicle in the direction of the aircraft seat after positioning the vehicle adjacent the aircraft seat and before moving the winch along the track.

47. The method according to claim 46 in which the step of effectively expanding the wheelbase of the vehicle includes extending laterally from the vehicle toward the aircraft seat and into contact with the floor of the cabin a stabilizer member which, as so extended, is secure from rotation upwardly relative to the vehicle.

48. The method according to claim 46 including the step of preventing movement of the winch along the track until after the vehicle wheelbase has been effectively expanded.

49. The method according to claim 44 in which the seat in the aircraft is an aisle seat.

50. The method according to claim 44 in which includes the step of establishing a vehicle-stabilizing contact between the vehicle and a location in the aircraft displaced from the vehicle in the direction of the aircraft seat from the vehicle before moving the winch along the track.

51. The method according to claim 44 including moving a person from the aircraft seat to a location outside the aircraft by effectively reversing the steps described in claim 57 and performing the reversed steps in substantially reverse order.

52. The method according to claim 44 including using the carrier and the winch at said location outside the aircraft to place the person on the seat in the vehicle.

53. The method according to claim 52 including moving the person via the winch and the carrier essentially directly from a different vehicle, such as an automobile, to the seat in said wheeled vehicle.

* * * * *